US011877650B1

(12) United States Patent
Salz

(10) Patent No.: US 11,877,650 B1
(45) Date of Patent: Jan. 23, 2024

(54) TENSION-STABILIZED KNOCK DOWN TABLE STRUCTURES ELIMINATING FASTENERS AND BRACES

(71) Applicant: David Salz, Davie, FL (US)

(72) Inventor: David Salz, Davie, FL (US)

( * ) Notice: Subject to any disclaimer, the term of this patent is extended or adjusted under 35 U.S.C. 154(b) by 0 days.

(21) Appl. No.: 17/748,449

(22) Filed: May 19, 2022

(51) Int. Cl.
*A47B 3/06* (2006.01)
*A47B 13/02* (2006.01)

(52) U.S. Cl.
CPC ..... *A47B 3/06* (2013.01); *A47B 13/02* (2013.01)

(58) Field of Classification Search
CPC ..... A47B 3/06; A47B 13/02
See application file for complete search history.

(56) References Cited

U.S. PATENT DOCUMENTS

| | | | | |
|---|---|---|---|---|
| 2,442,150 | A | 7/1881 | Fenby | |
| 2,209,145 | A | 7/1940 | Weber | |
| 2,691,410 | A | 10/1954 | Boucher | |
| 3,195,954 | A | 7/1965 | Moreno | |
| 3,635,520 | A | 1/1972 | Roher et al. | |
| 3,708,204 | A | 1/1973 | Wachsmann | |
| 4,338,867 | A | 7/1982 | Imber | |
| 4,494,796 | A | 1/1985 | Liebhold | |
| 5,320,404 | A * | 6/1994 | Le Gal | A47C 9/105 297/16.2 |
| 6,334,284 | B1 | 1/2002 | Provitola | |
| 6,418,673 | B1 | 7/2002 | Flowerday | |
| 6,619,749 | B2 | 9/2003 | Willy | |
| 6,868,640 | B2 | 3/2005 | Barber | |
| 7,278,245 | B2 | 10/2007 | Rouse | |
| 10,201,231 | B2 | 2/2019 | Homans et al. | |
| 2003/0182874 | A1 * | 10/2003 | Barber | E04B 1/19 52/81.1 |
| 2008/0083858 | A1 * | 4/2008 | Goodman | A47B 13/02 248/188.8 |
| 2014/0250593 | A1 * | 9/2014 | Kim | A47B 3/06 108/159 |
| 2018/0070718 | A1 * | 3/2018 | Insinna | A47F 5/10 |
| 2021/0219711 | A1 * | 7/2021 | Lai | A47B 13/003 |
| 2021/0219726 | A1 * | 7/2021 | Salz | A47C 7/282 |

FOREIGN PATENT DOCUMENTS

AT 525043 B1 * 12/2022

* cited by examiner

*Primary Examiner* — Daniel J Rohrhoff
(74) *Attorney, Agent, or Firm* — Dale Paul DiMaggio, Esq.; Malin Haley DiMaggio & Bowen, P.A.

(57) ABSTRACT

Tension-stabilized table structures and frame assemblies to form simplified flat packing furniture that eliminates all fasteners, welds, support hardware and braces. Simplified assembly of pre-tensioned structures providing improved stability, uniformity of support and visual aesthetics. The support systems consist of pre-bent tubes or rods that are linked together to form spring networks that are stabilized and locked together by the balancing of tension and compression. Tabletops or tensioning elements can complete the spring networks to provide tension to the entire assembly, resulting in highly stable tables.

6 Claims, 26 Drawing Sheets

TENSION-STABILIZED KNOCK DOWN TABLE STRUCTURES ELIMINATING FASTENERS AND BRACES

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to furniture structures and improved systems, and more particularly to knock down tables and other furniture having the instant novel tension-stabilized designs that eliminate support crossbars, braces, hardware, fasteners, hinges, welds and the like, and greatly increase efficiency and simplify assembly.

2. Description of the Background Art

Any art described in this section is not intended to constitute an admission that any patent, publication or other information referred to herein is "prior art" with respect to this invention, unless specifically designated as such. In addition, this section should not be construed to mean that a comprehensive search has been made or that no other pertinent information as defined in 37 C.F.R. § 1.56(a) exists.

Conventional knock down table structures rely on fasteners, braces, hinges and other hardware for stability, folding and assembly. Those mechanical parts are cumbersome, add expense in manufacturing, and bear the highest loads within those structures, therefore tending to be the primary points of structural failure.

For example, the Imber U.S. Pat. No. 4,338,867 illustrates an assembled table and incorporates legs seated into inwardly canted rigid sockets within the tabletop, and a lower central biasing ring which presses the legs outwardly into frictional contact with the socket walls. The legs and table are stabilized by a central captive ring. Horizontal reinforcing struts are secured to the legs with hardware, and the central spreader ring presses on the inside surfaces of the legs and the struts.

The Rouse U.S. Pat. No. 7,278,245 describes complex designs for different embodiments of variety of products including tables, and chairs. The central member is a radial-hinge mechanism assembly having numerous elongated arms or legs integrated into a geometric closed-loop design having versatile spring-biasing techniques. The function is to provide a variable function of pivoting open from a center hinge-core as its circular inner-aperture concurrently contracts in its own circular dimensions.

The Le Gal U.S. Pat. No. 5,320,404 relates to different foldable furniture designs such as chairs or tables, having an "underframe" for support. The underframe includes three or more crosspieces formed of jointed struts with ends that pivot and are connected to one-another. The connections are made with elastic and deformable sleeves, with lower sleeves for ground support and upper sleeve assembly for furniture support, including a tabletop or chair with fabric material, and collapsible features.

As a further example, the Lorenz European Patent Application Publication No. 0888735 relates to a table having U or V shaped tubular legs, each leg having two upward legs. The upward legs, having bent or tilted ends, are spread outwardly, and the ends inserted into the bottom of the tabletop, the bottom having rigid receiving cylindrical mounting openings as molded sockets that are spaced out and around a spreading ring, to stabilize and exclude wobbling of the table.

Another example is the Mariano French Patent Application Publication No. 1134369, which illustrates a tubular support for a fabric table or chair with a collapsible frame having three support points/sections. The frame consists of six asymmetrical J-shaped tubes that interconnect with male and female ends to form an undulating structure. The triangular cover fabric and three straps are suspended on the three upper elbows of the frame.

None of the prior art or conventional knock down table structures provide the simplicity of the instant user friendly assembly, the elimination of required hardware, braces or extraneous members, the inherent stability and self-tensioning, or the robustness of the instant table designs and inventions, which constitute a substantial improvement over the art.

It is therefore an objective of the present invention to provide improved table and furniture structures which are user friendly and relatively simple in design, components, assembly and operation, and which eliminate the need for tools and provide for increased stability.

It is yet another objective of the present invention to provide improved table structures that provide greater uniformity of support while minimizing the number of components required and eliminate extraneous hardware, support members, brackets and cross braces.

It is yet another objective of the present invention to provide improved table designs that are superior to prior designs, are easier to assemble, and provide for robust, self-tensioning and self-stabilizing support.

Finally, it is an objective of the present invention to provide improved tables designs that are cost effective and operationally efficient while incorporating the above-mentioned objectives and features.

SUMMARY OF THE INVENTION

The improved table designs disclosed herein utilize tension-stabilized frame support assemblies to form simplified flat packing tables that eliminate all hardware, fasteners, hinges, welds and braces. In addition to simplifying assembly, these pre-tensioned resilient structures provide improved stability, uniformity of support and visual aesthetics. The support framework consists of pre-bent tubes or rods that are linked together to form spring networks that are stabilized and locked together by the balancing of tension and compression. Surface elements or connectors apply tension by displacing the support elements, either increasing or decreasing their included angles. The balance of tension and compression stabilizes the structure. Tabletops and tensioning elements can complete the spring networks to provide tension to the entire assembly, resulting in highly stable tables.

The instant inventions and table support systems teach the use of support frame members consisting of generally symmetrical formed tubes or rods that interconnect but remain unstable until the application, positioning and engagement of tensioning elements that tension and stabilize them, resulting in assemblies that behave as springs under tension. Unlike conventionally stabilized structures, these minimally constrained structures provide substantial motional freedom that enables them to survive impacts and overloads. Forces applied to these structures are absorbed and counteracted by the overall balancing of tension and compression in a flexibly constrained apparatus. This self-stabilization function is both rare and remarkable because it only exists in conjunction with the idealized mechanical characteristic of distributed compliance, where strength is maximized by distributing stress uniformly throughout an assembly. This advantage does not exist in previous knock down table designs, which are classified as lumped compliance devices because they concentrate stress on specific points.

BRIEF DESCRIPTION OF THE DRAWINGS

The invention may be better understood by reference to the drawings in which.

DETAILED DESCRIPTION OF PREFERRED EMBODIMENTS

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges or lengths may be expressed generally herein, for example "shorter", from "about" or "approximately" one particular value or reference and/or to "about" or "approximately" another particular value or reference. Similarly, "outwardly", "upwardly" or similar terms are used in its general definition without a particular range or value. When such a range, length or term is expressed, another embodiment includes from the one particular value and/or to the other particular value. Similarly, when values or terms are expressed as approximations, by use of an antecedent "about", "generally" or similar terms it will be understood that the particular value or term forms another embodiment.

Figure 1A:
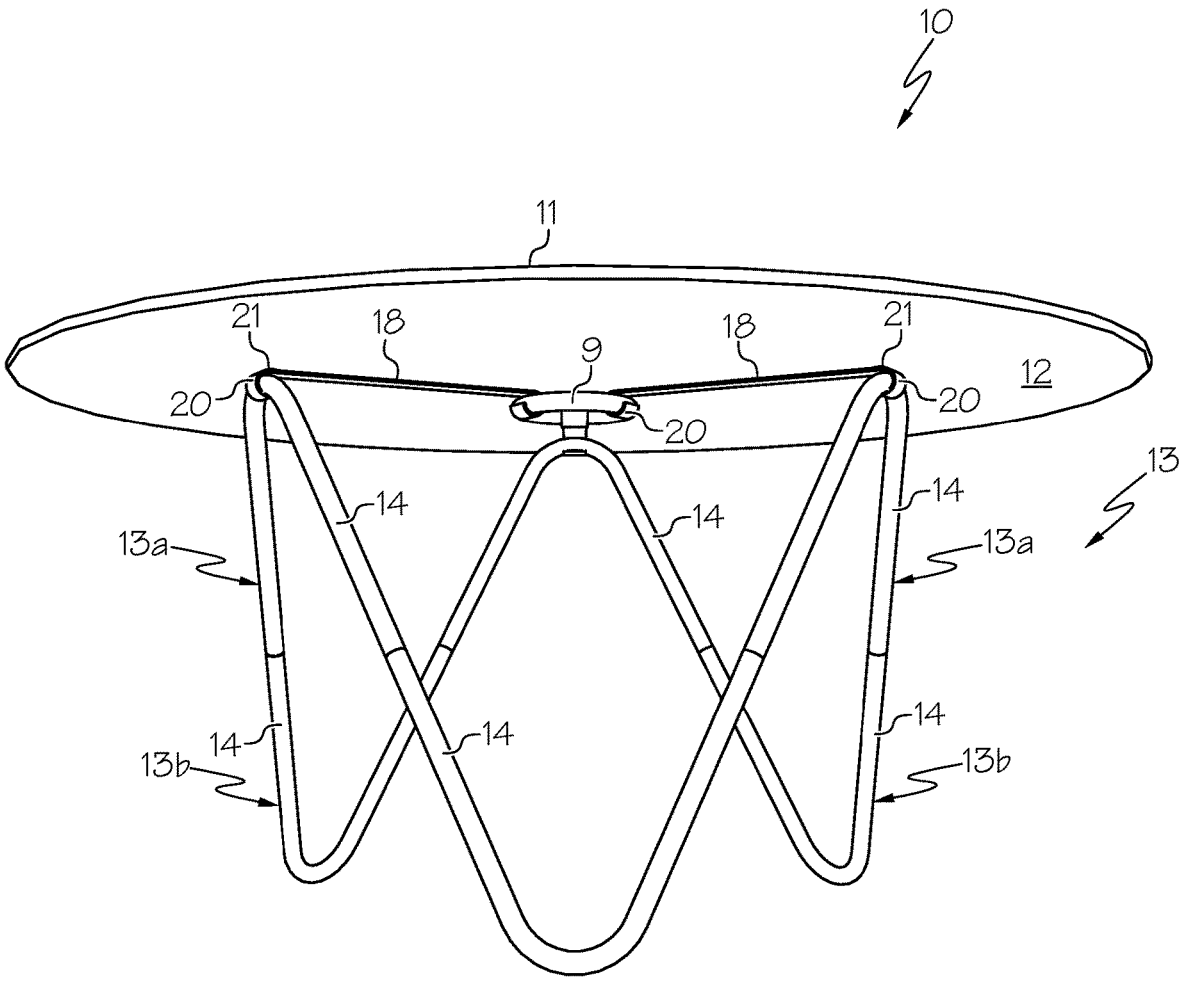
FIG. 1A is a perspective view of an embodiment of the inventive table and support system in an assembled table design.

With reference to FIG. 1A, the instant table and support system is shown in the furniture configuration of a glass-top round table 10, wherein a rigid tabletop 11 and underside 12 rests upon a frame assembly 13, in this embodiment consisting of six V-shaped tubes, a ring and three rigid straps 18 that are all linked together to provide the tension-stabilization as hereinafter described. Frame assembly 13 has upper support frame members 13*a* and lower support frame members 13*b*, each having support elements consisting of six identical metal tubes 14 bent generally into a V or similar shape with opposing legs or generally straight leg sections, and tensioning elements consisting of a central ring 9 and three rigid metal straps 18 with hook shaped ends 20. Hook shaped ends 20 receive central ring 9 and at the opposite ends of straps 18 receive tubes 14. Soft plastic discs 21 are affixed to each strap 18, providing appropriate contact points for the glass top. As illustrated the upper support frame members 13*a* are inverted above the lower support frame members 13*b*. The number of elements and shapes can vary according to considerations of application and style.

Figure 1B:
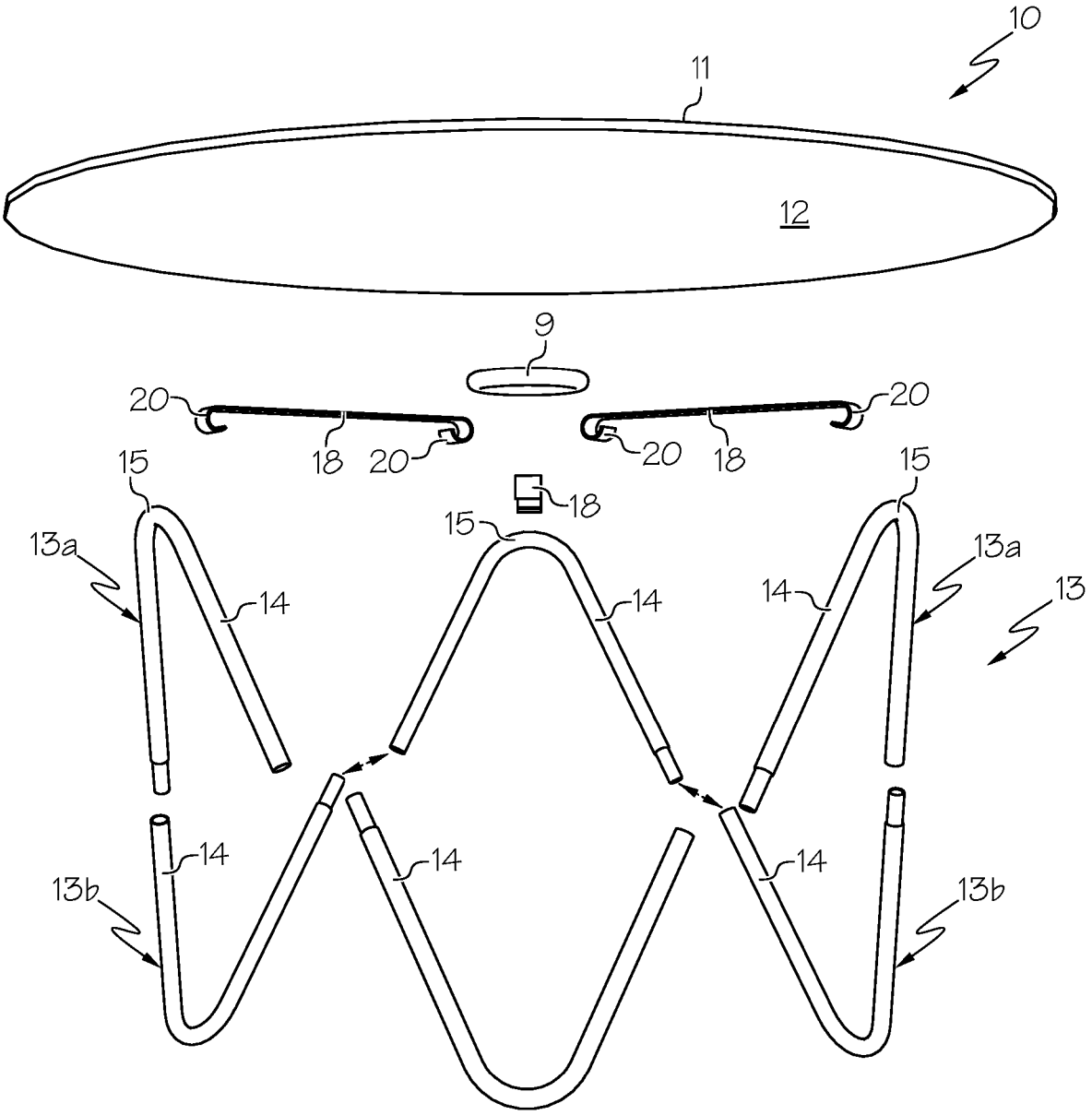
FIG. 1B is an exploded perspective view of the table design depicted in FIG. 1A.

FIG. 1B is an exploded perspective view of the table shown in FIG. 1A, illustrating the table 11 and frame assembly 13 with the mechanical components in a disassembled configuration. The uppermost section 15 of tubes 14 and support frame assembly 13 are connected to and engage the hook shaped ends 20 of straps 18.

As shown in FIGS. 1A and 1B, the upper legs of each upper support frame member 13*a* are alternately connected to lower legs of adjacent lower support frame members 13*b*.

Figure 1C:
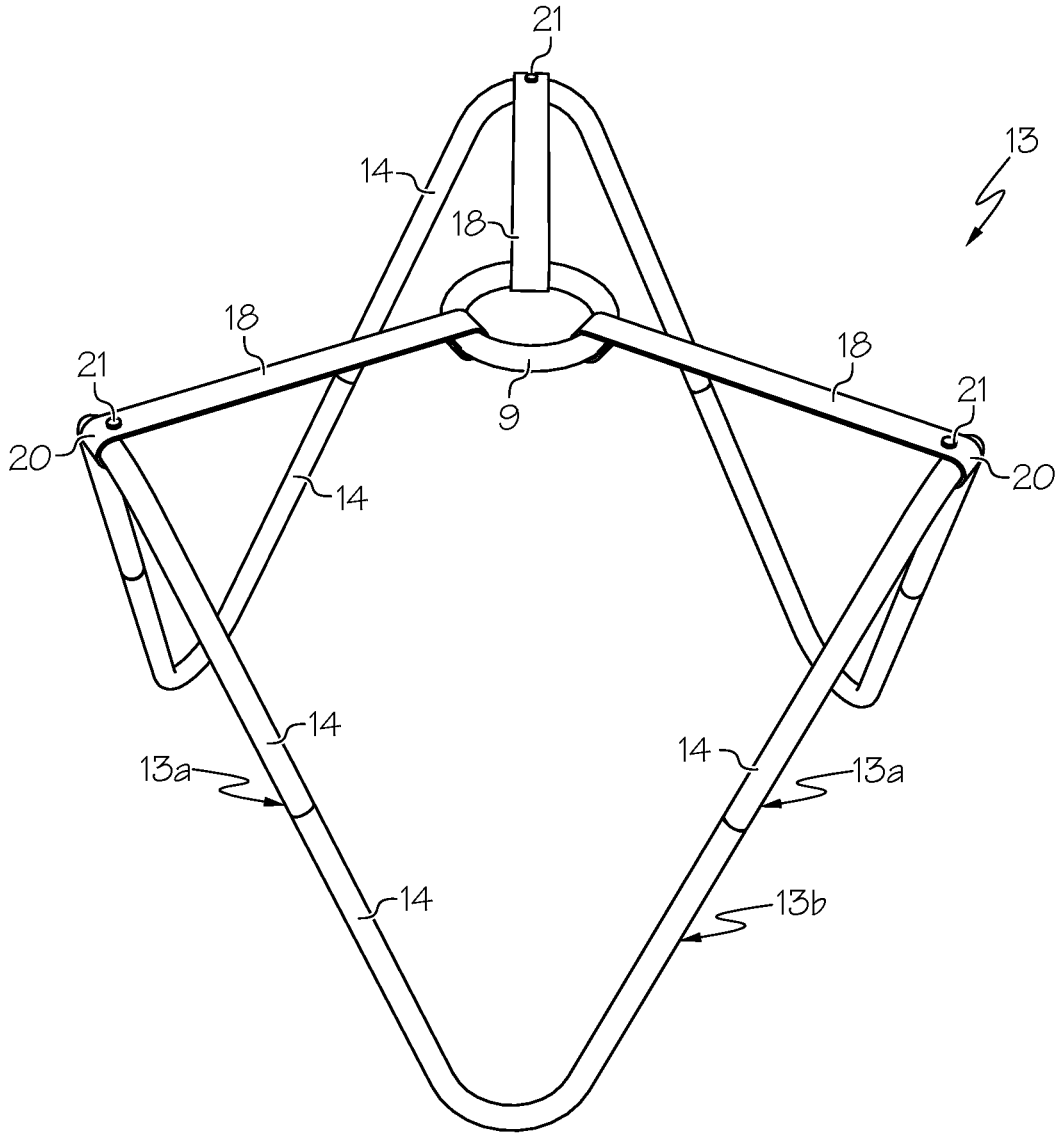
FIG. 1C is a perspective view of the support frame section of the table design shown in FIG. 1A.

FIG. 1C is a perspective view of only the assembled framework of frame assembly 13 of the table 10 shown in FIG. 1A. Assembly begins by inserting male ends of the six V-shaped tubes 14 into the female ends in a male/female configuration or joinder, forming an undulating structure that is unstable because the connections are free to rotate. Engaging and attaching the uppermost ends of the support frame members to the tensioning straps 18 at hook ends 20 compresses all six of the V-shaped tubes, reducing the included angle of their bends as it stabilizes the structure and forces the engagement of the connections. To create that compression, the length of the strap connections is intentionally made shorter than the distance between the ring and upper support tubes, so the tube tops must be pulled inward to make the connections.

Figure 1D:
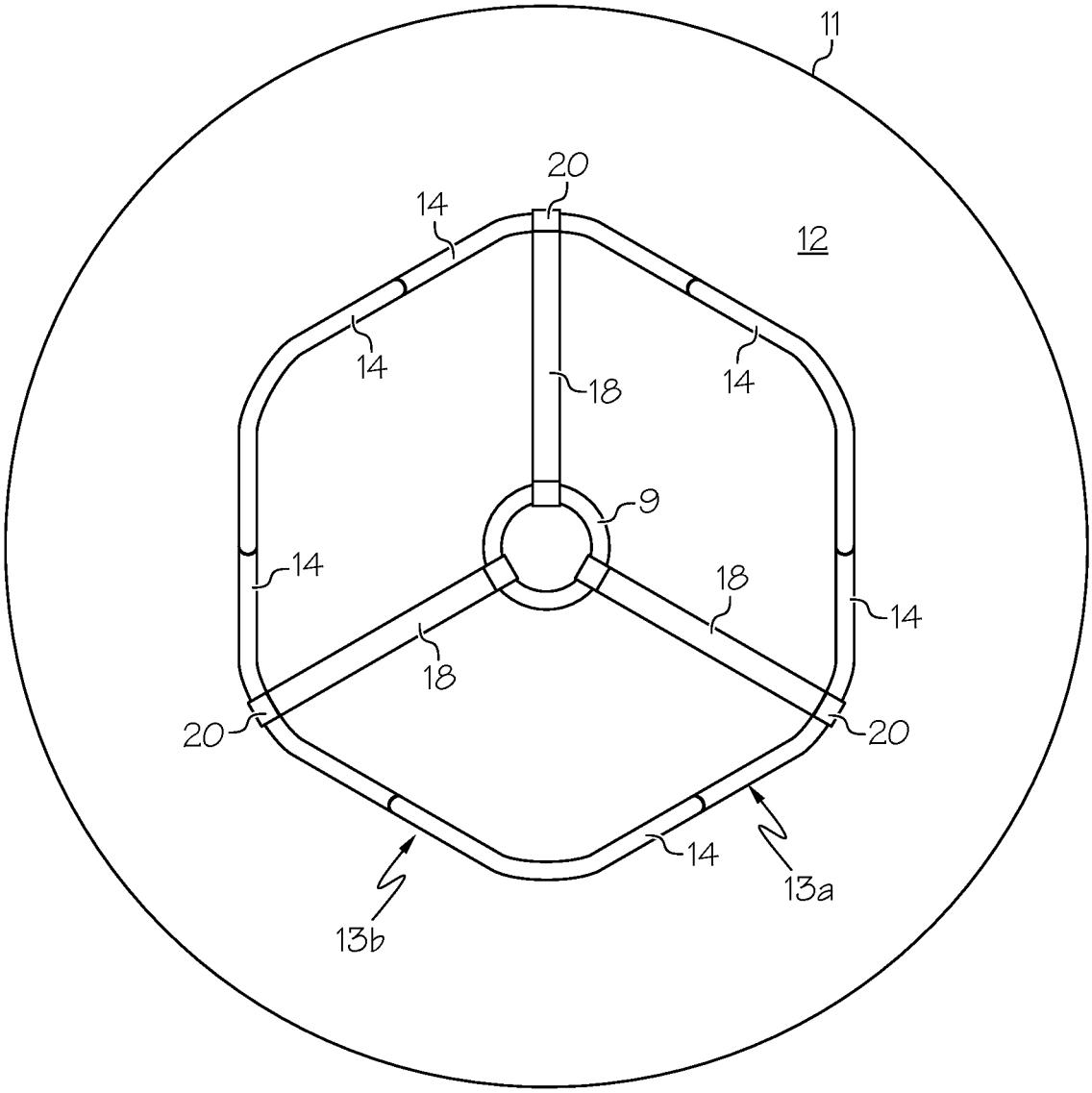
FIG. 1D is a bottom plan view of the support frame of the table design shown in FIG. 1A.

FIG. 1D illustrates a bottom view of frame assembly 13 shown in FIG. 1C. The balancing of tension and compression within the structure causes the three straps 18 to maintain a stable 120 degree relationship. This self-stabilizing behavior is an example of the remarkable ability of these structures and the frame assembly members to recover from substantial deformations without damage. It is important to note that symmetrical V-shaped elements are necessary to create this function because tension applied to a similar frame made of asymmetrical J-shaped elements will tend to twist the frame and bind the rotating connections.

Figure 2A:
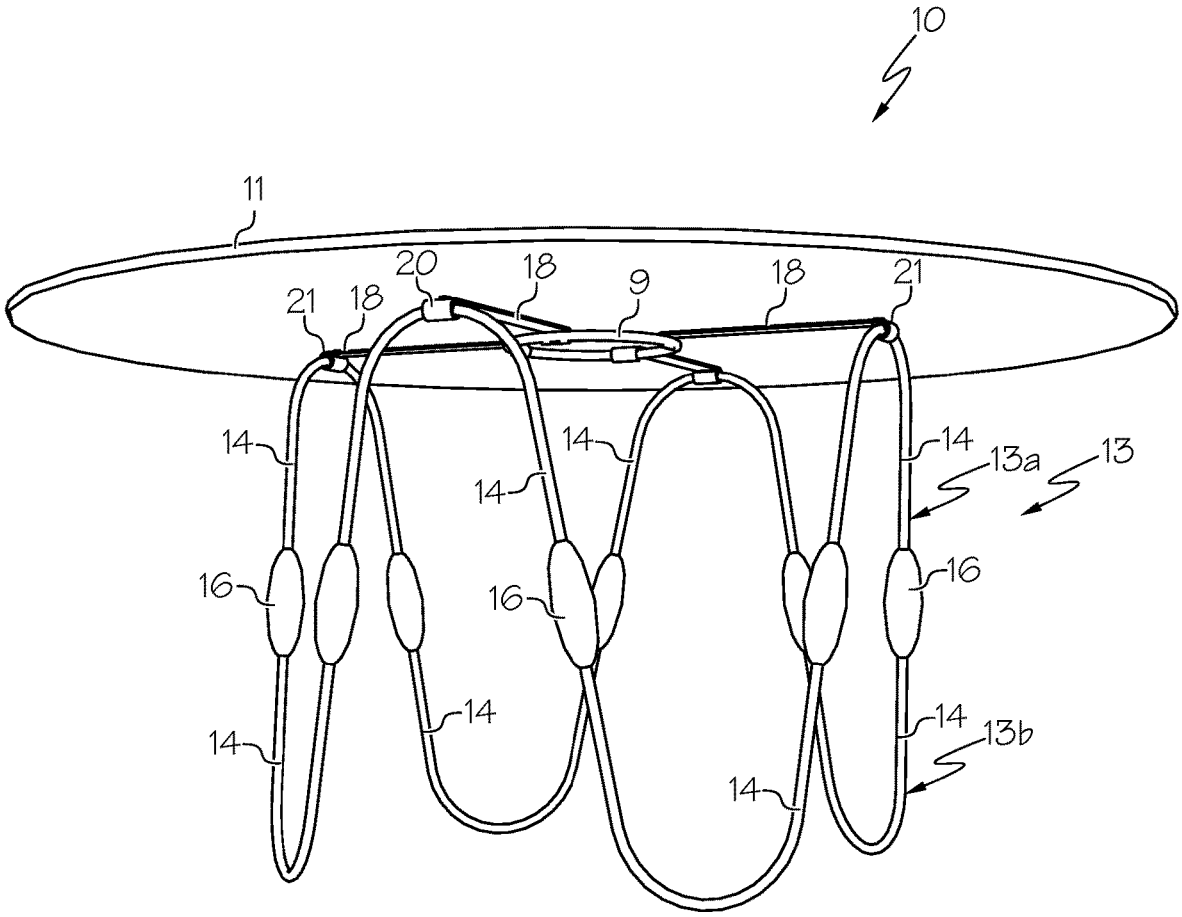
FIG. 2A is a perspective view of an embodiment of the inventive table and support system in an assembled table design.

With reference to FIG. 2A, the instant table and support system is shown in the furniture configuration of a glass-top round table 10, wherein a rigid tabletop 11 rests upon a frame assembly 13, in this embodiment consisting of eight rods that are linked together and tensioned by a central ring 9 and four straps 18 to provide the tension-stabilization as hereinafter described. Frame assembly 13 has elements consisting of eight identical metal rods 14 bent generally into a V or similar shape, eight rod connectors 16 generally in an externally oval shape, a central ring 9 and four rigid metal straps 18 with hook shaped ends 20. Soft plastic discs 21 are affixed to each strap 18, providing appropriate contact points for the glass top. The number of elements and shapes can vary according to considerations of application and style.

Figure 2B:
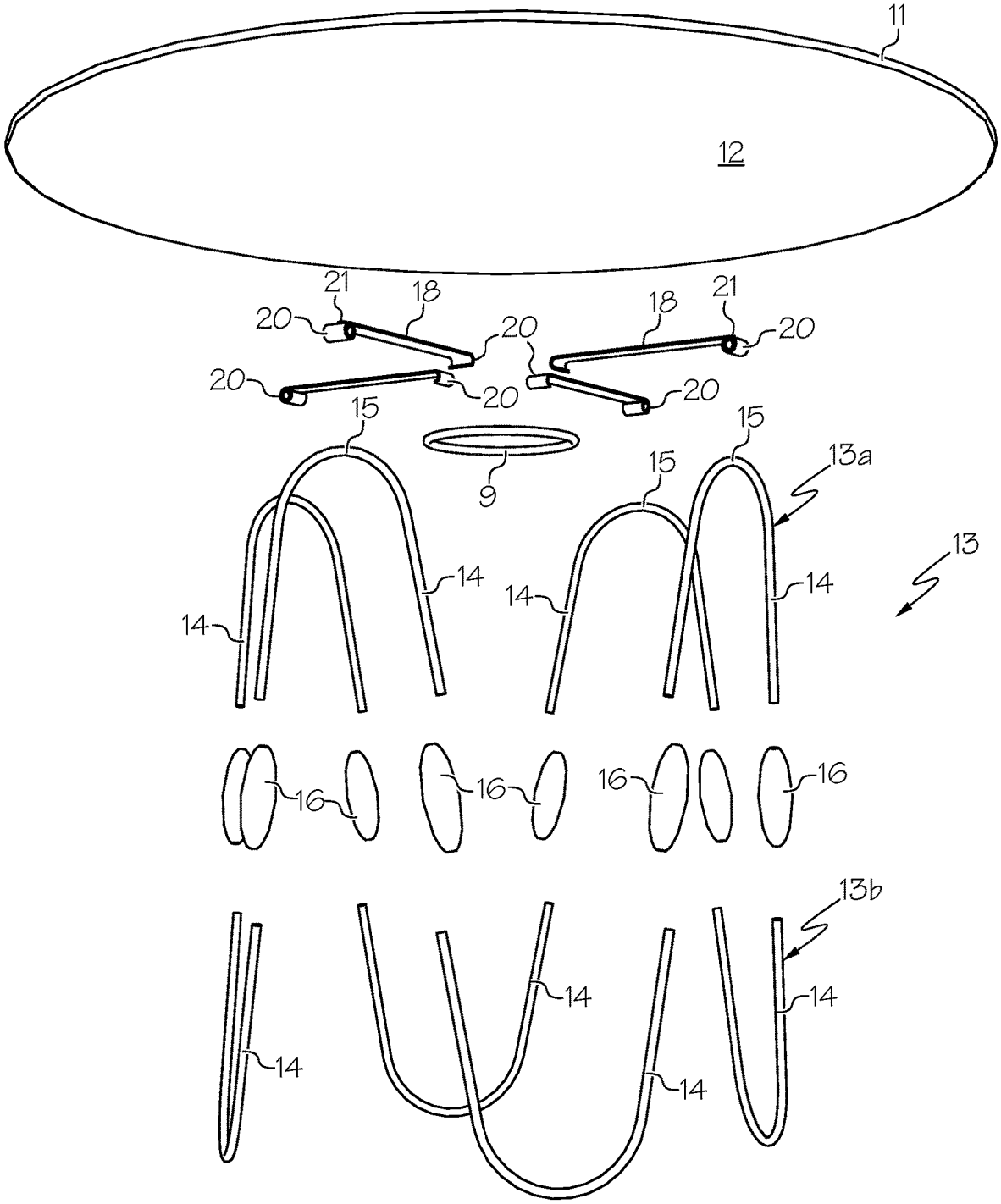
FIG. 2B is an exploded perspective view of the table design depicted in FIG. 2A.

FIG. 2B is an exploded perspective view of the table shown in FIG. 2A, illustrating the table 11 and frame assembly 13 with the mechanical components in a disassembled configuration. The uppermost section 15 of rods 14 and frame assembly 13 are connected to and engage the hook shaped ends 20 of the rigid straps 18.

Figure 2C:
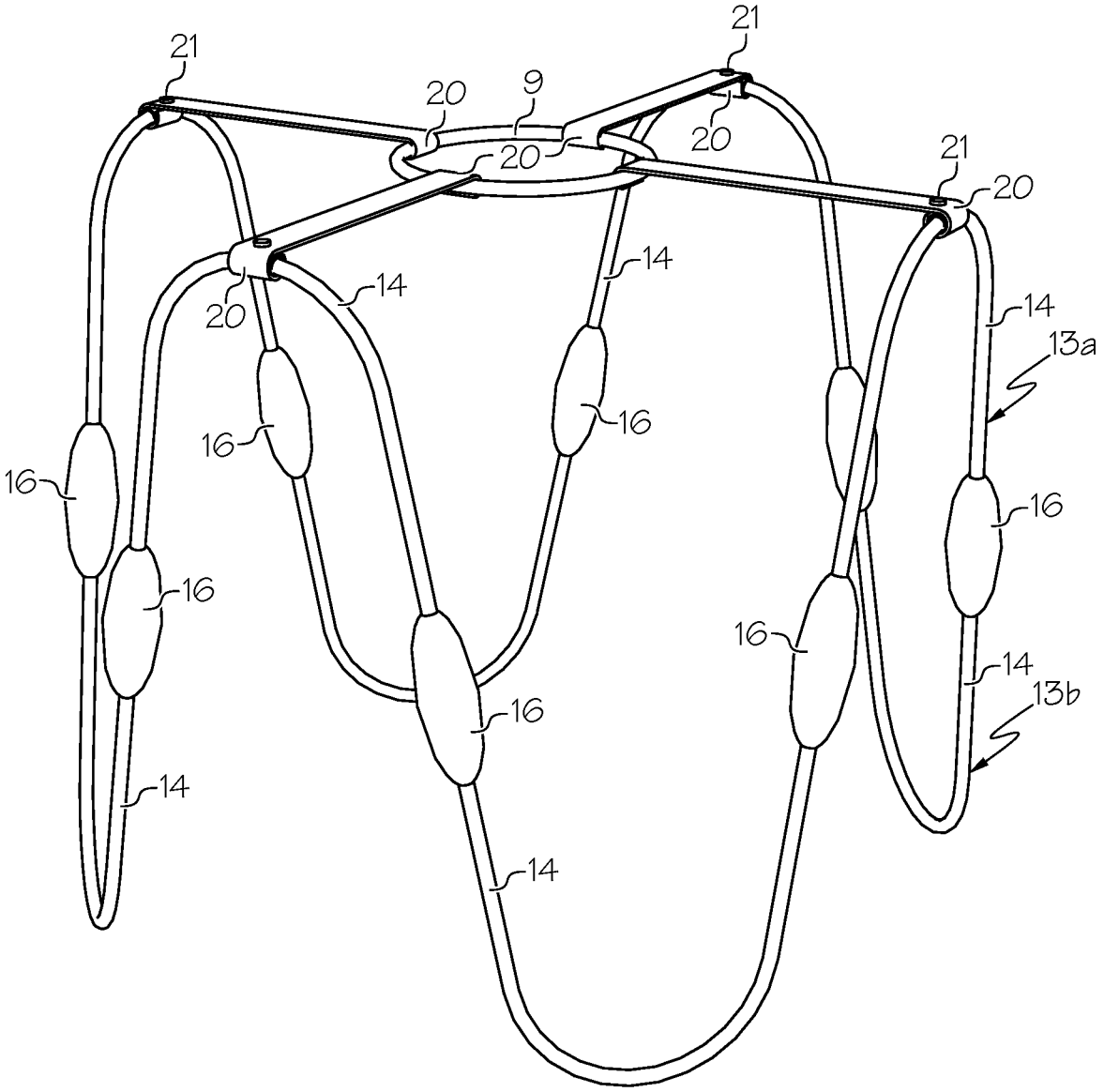
FIG. 2C is a perspective view of the support frame section of the table design shown in FIG. 2A.

FIG. 2C is a perspective view of only the assembled framework of frame assembly 13 of the table 10 shown in FIG. 2A. Assembly begins by inserting the eight V-shaped rods 14 into oval connectors 16 in a male/female configuration or joinder. Connectors 16 have internal sockets or voids which are geometrically and cylindrically shaped to receive and mate with rods 14. Having a cylindrical shape, rods 14 are inserted into connectors 16 in a sliding engagement, forming an undulating structure that is unstable because the rods are free to rotate inside the connectors 16. Engaging and attaching the support frame members to the central ring 9 and straps 18 at hook ends 20 compresses all eight of the V-shaped rods, reducing the included angle of their bends as it stabilizes the structure and forces the engagement of the connections. To create that compression, the length of the straps is intentionally made shorter than the distance between the ring and the upper support frame members, so the members must be pulled inward to make the connections.

Figure 2D:
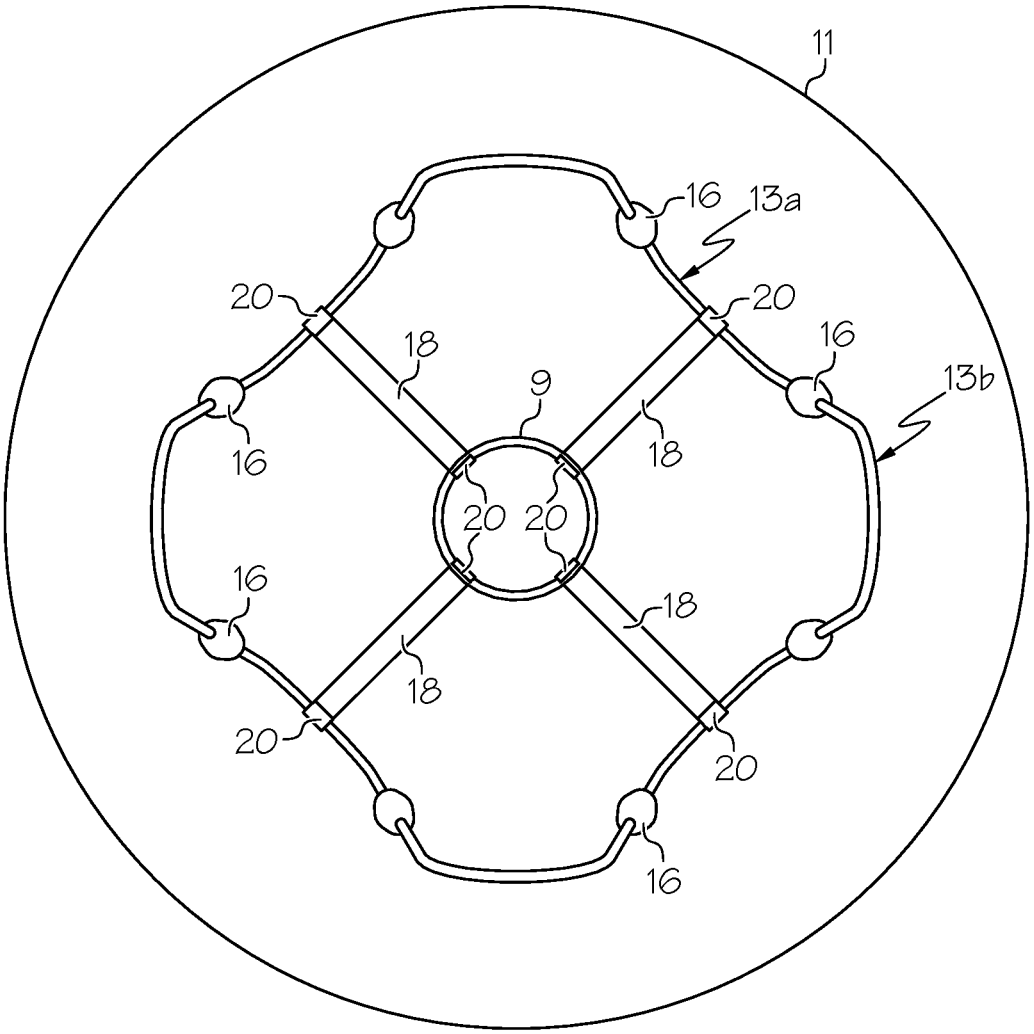
FIG. 2D is a bottom plan view of the support frame of the table design shown in FIG. 2A.

FIG. 2D illustrates a bottom view of frame assembly 13 shown in FIG. 2C. The balancing of tension and compression within the structure causes the four straps 18 to maintain a stable perpendicular relationship. Upon engagement, the self-stabilizing behavior is an example of the remarkable ability of these structures and the frame assembly members to recover from substantial deformations without damage.

Figure 2E:
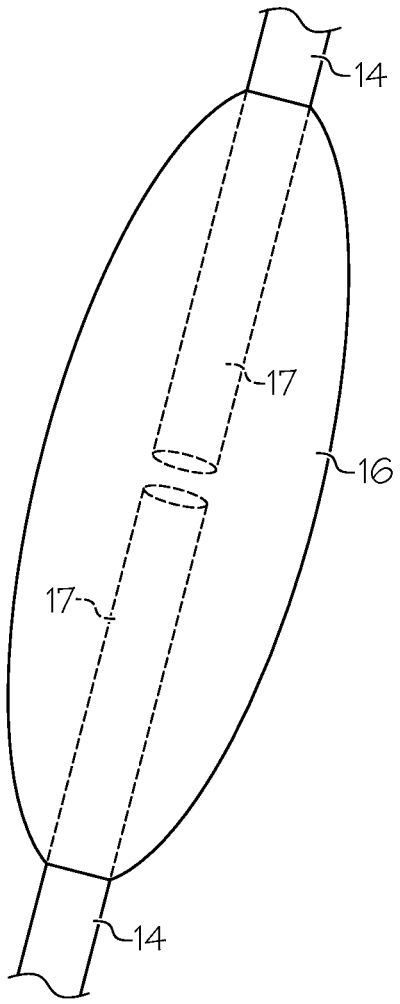
FIG. 2E is a cross-sectional side plan view of a rod connector with rods inserted of the instant invention.

FIG. 2E is a cross-sectional side plan view of rods 14 inserted within connector 16. As discussed above, the sliding engagement and mating geometry of the rods 14 and cylindrical voids or sockets 17 within connector 16 allow for the rotational movement of the frame assembly 13 unit, which becomes stabilized by the balancing of tension and compression forces only when attached to cross-members 18.

Figure 2F:
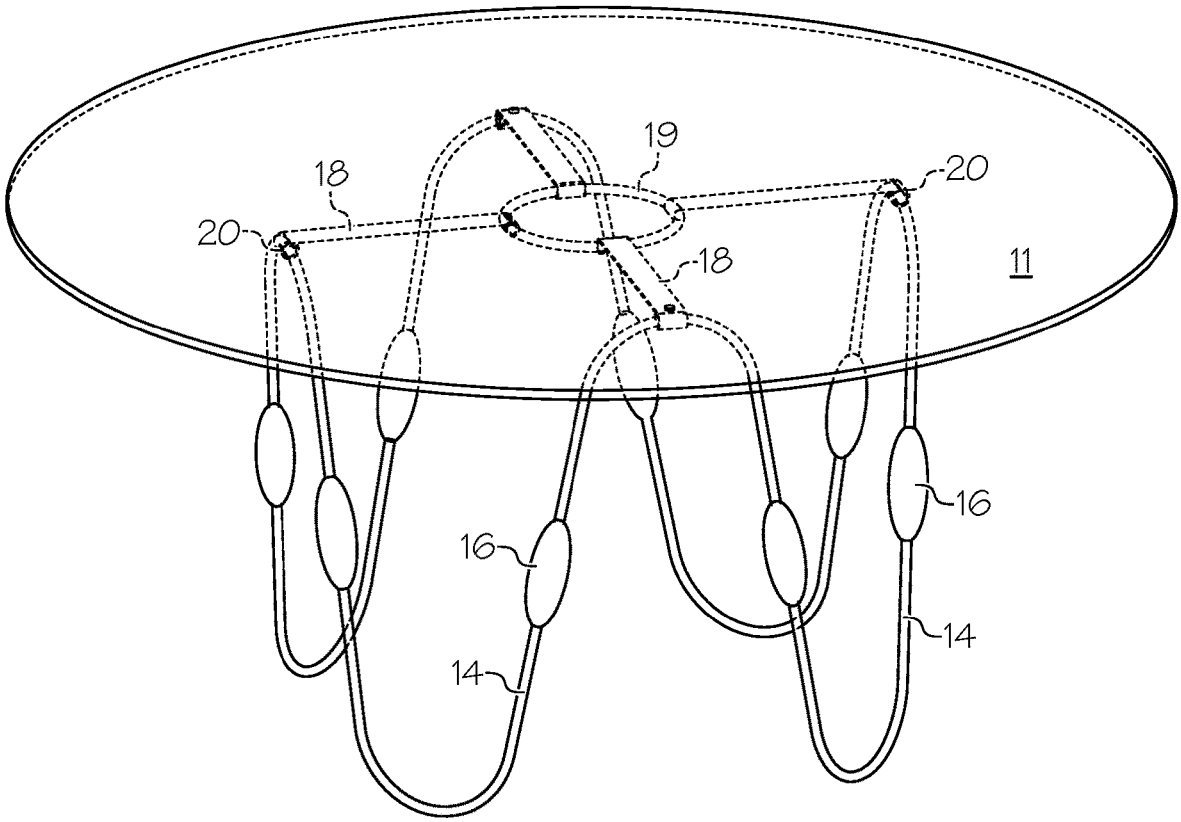
FIG. 2F is an alternative perspective view of the support frame and table design shown in FIG. 2A.

FIG. 2F is an alternative top perspective view of the table and frame assembly of FIG. 2A.

Figure 3A:
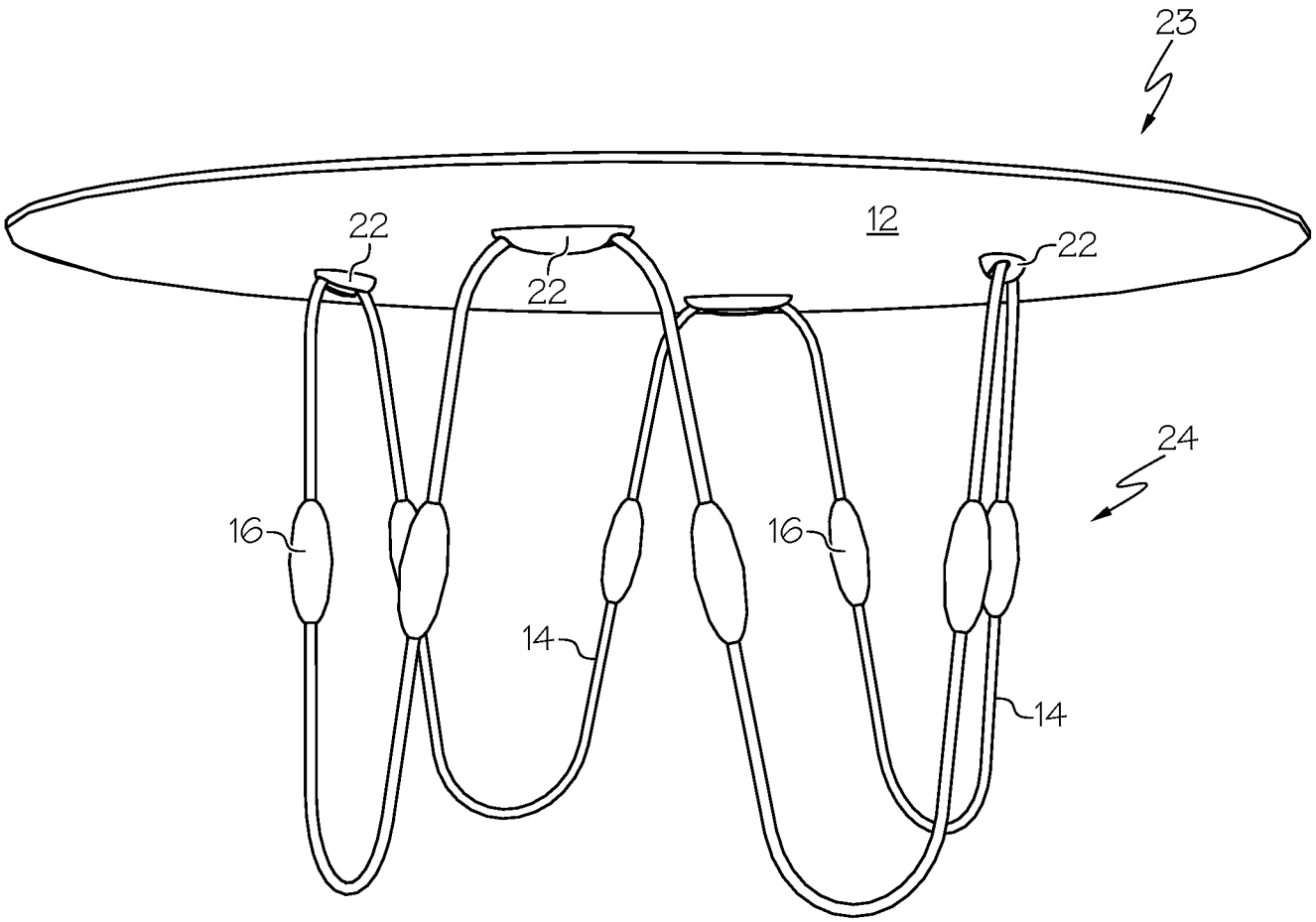
FIGS. 3A is a perspective view of an alternative embodiment of the inventive table and support system in an assembled table design.
Figure 3B:
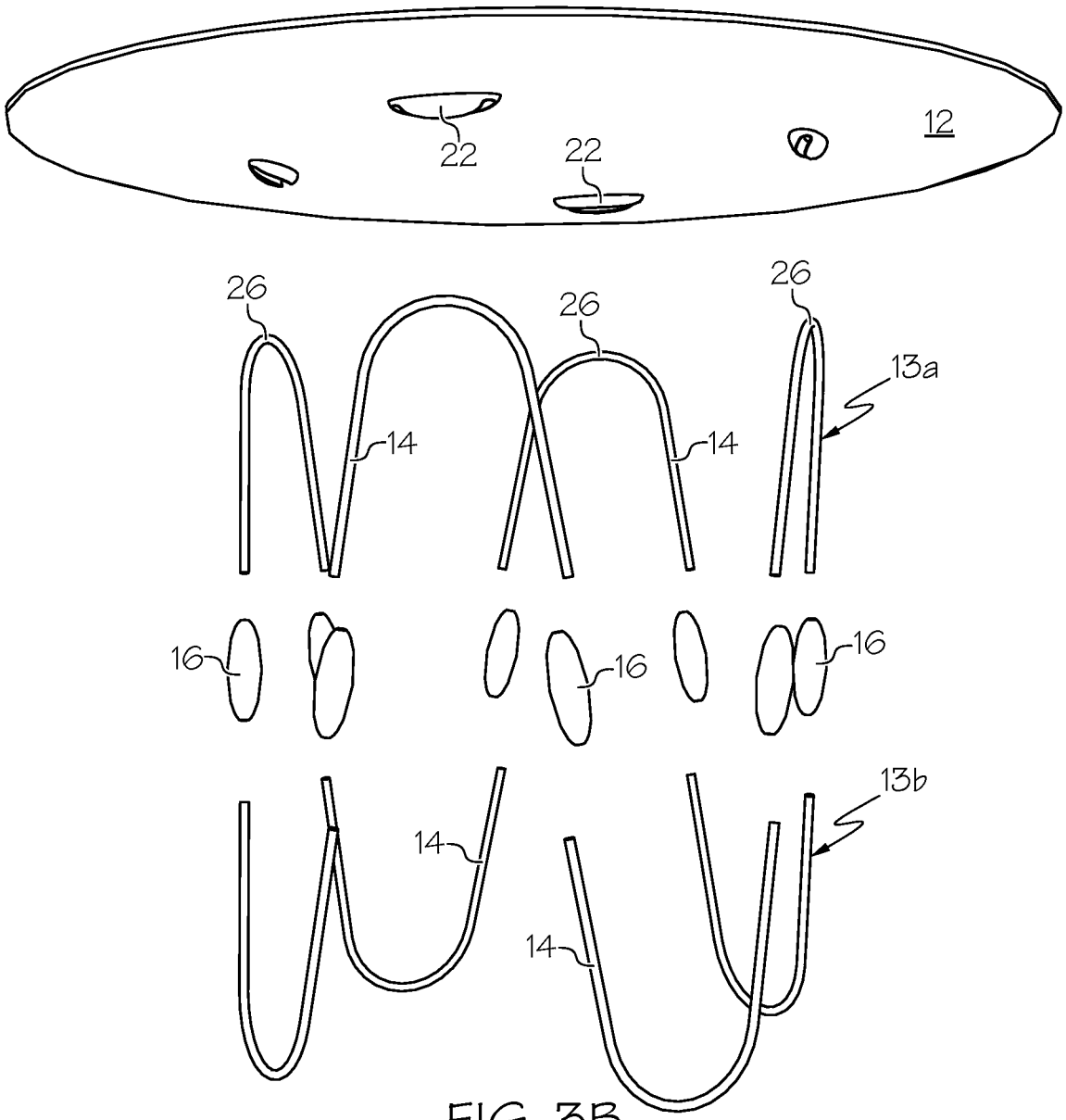
FIG. 3B is an exploded perspective view of the table design depicted in FIG. 3A.

FIG. 3A is a perspective view of an alternative embodiment of the inventive table and support system in an assembled configuration of round dining table 23. This frame assembly 24 also includes rods 14, with uppermost sections 26 (as shown in FIG. 3B), and connectors 16. However, central ring and straps 18 have been eliminated, and the underside surface 12 of the table has four independent angled slot receivers 22 that engage and retain the uppermost sections 26 of rods 14. The entire frame assembly 24 has been tensioned, compressed and stabilized by engagement with the receivers on the underside of the table surface. Even though the stable location of these four connections is more restrictive than the free-floating ring and straps employed in the embodiments shown in FIGS. 1 and 2, the slot receivers 22 still allow angular movement of the frame elements. In both embodiments, the combination of tension, flexibility and rotating connections enable the elements to transmit applied forces through the entire structure as angular movement without generating destructive shear forces where the elements connect. Therefore, the two embodiments behave similarly in stabilization and recovery from deformation as described above.

FIG. 3B is an exploded view of the table shown in FIG. 3A, illustrating the frame assembly 24 detached from the table underside surface 12, and prior to being attached and engaged with receivers 22.

With respect to all the table embodiments described herein, the inserted connections that join the frame elements form non-rigid and unstable frame assemblies. These frames are unstable because the male-female socket connections between the frame elements can rotate freely. The resulting instability allows the alignment of the interconnected parts to change as forces are applied to the assembly. The act of engaging the frame with the tensioning elements or slot features applies tension that directs the frame elements into their intended geometric alignment, which is dynamically stabilized by the balance of tension and compression. It is only when the tensioning element or elements are attached to the support elements that the compression and tension forces are applied, forming a generally rigid and stable furniture piece. This self-stabilizing behavior is made possible by the formulation of geometric configurations that actively engage the frame connections when tension is applied.

The table surface can be a composite material, wood, glass or stone. Rods, tubes, straps and rings are preferably made of steel or aluminum, although other suitable materials can be utilized. The oval (or other) shaped rod connectors may be made of glass, metal, wood, plastic or other rigid materials.

Figure 4A:
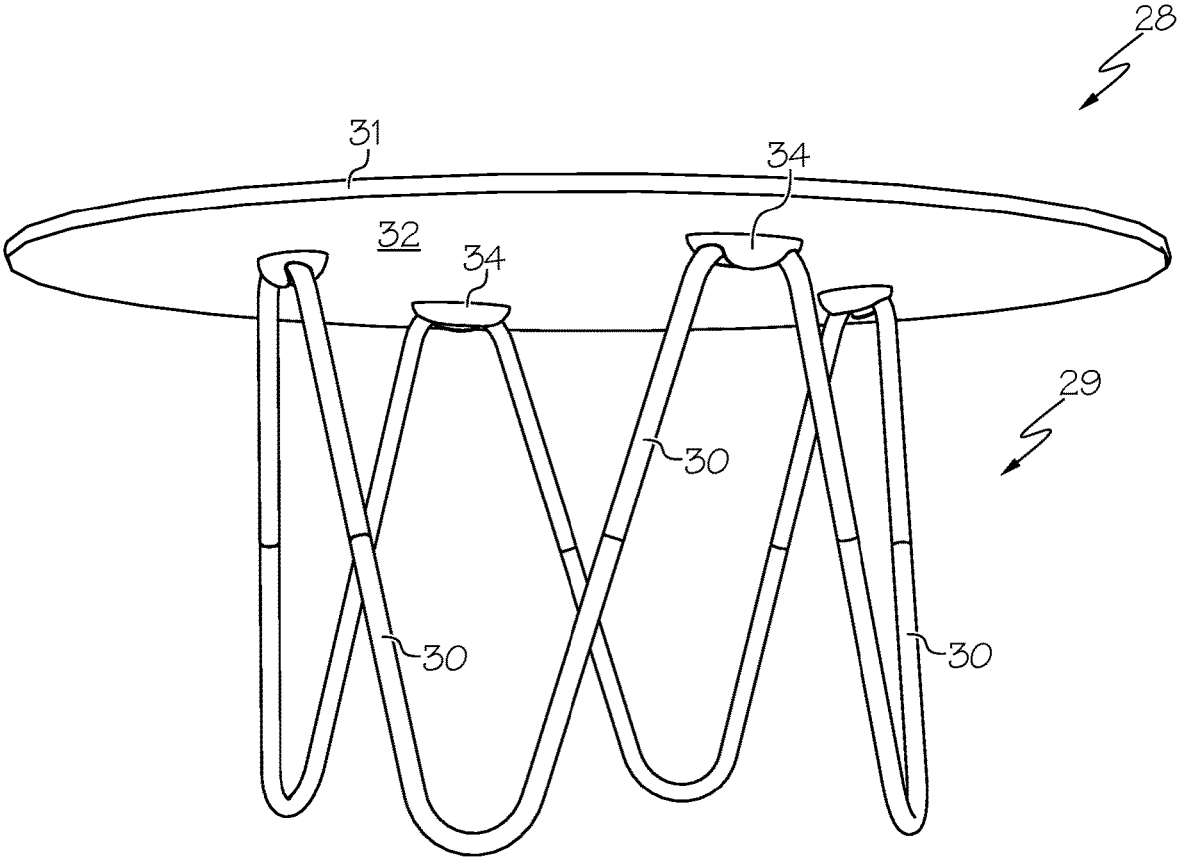
FIG. 4A is a perspective view of an alternative embodiment of the inventive table and support system in an assembled table design.
Figure 4B:
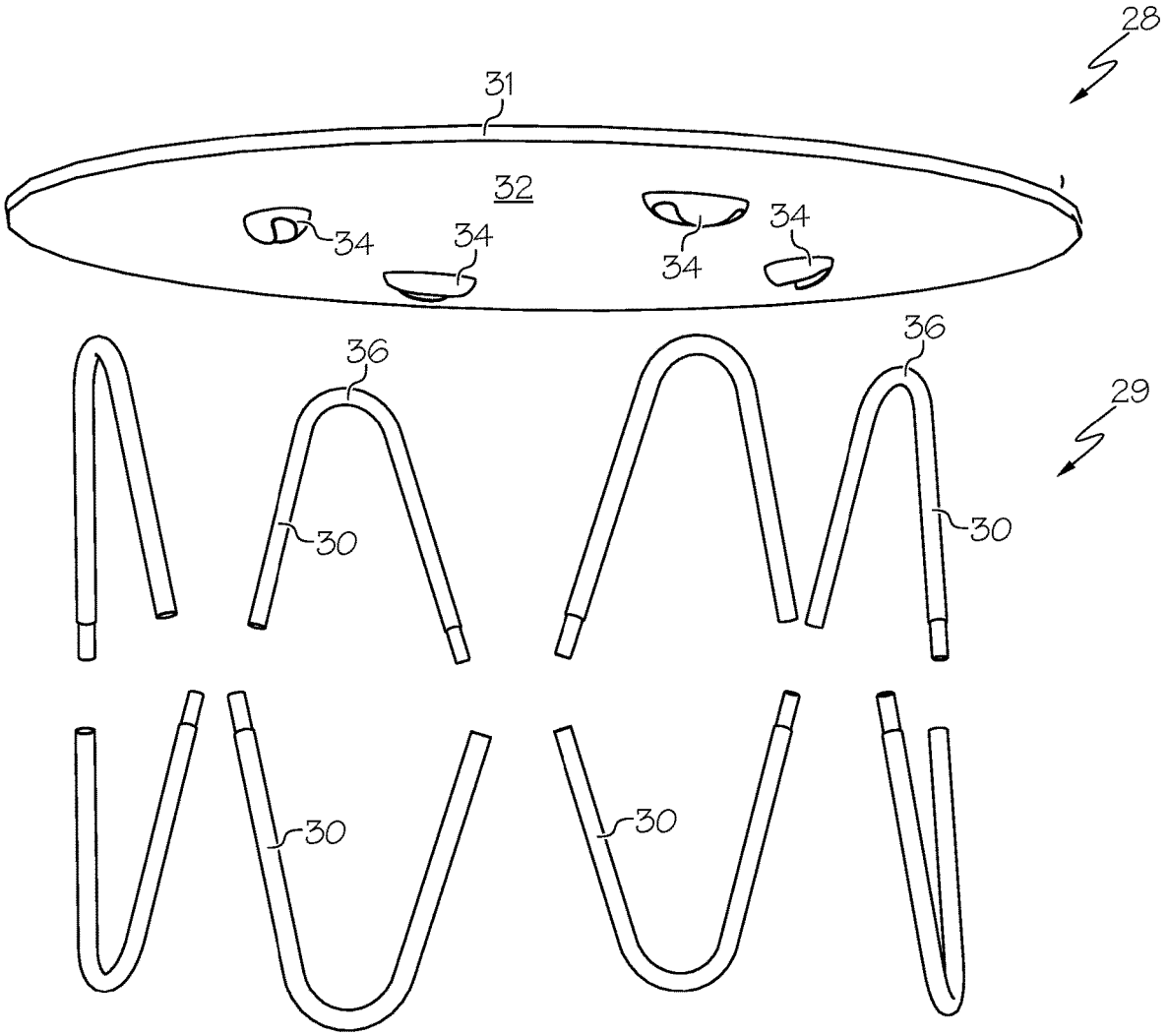
FIG. 4B is an exploded perspective view of the table design depicted in FIG. 4A.

FIG. 4A is an assembled dining table 28 consisting of eight identical tubular members 30 and a rigid top 31 with four slot receivers 34 on the underside 32 of the tabletop 31. The slot receivers 34 engage and retain the uppermost sections 36 (as seen in FIG. 4B) of tubes 30. There are no other associated fasteners, support members, hardware, cross bars, hinges, plates, or straps of any kind that are utilized or attached to this structure. As described above, the inserted tubular elements 30 alone comprise a non-rigid and unstable frame assembly 29 because their sliding engagement and male-female socket connections are free to rotate. This instability allows the alignment of the tubes 30 to shift as forces are applied to the frame 29. Attaching the tabletop 31 to frame assembly 29 through receivers 34 then applies compression and tension forces that form a generally rigid and stable furniture piece. The geometric relationship of those elements also ensures the engagement of the frame connections, even as varying different loads and forces are applied to the structure.

FIG. 4B is an exploded perspective view of the structural components of table 28 shown in FIG. 4A.

Figure 5A:
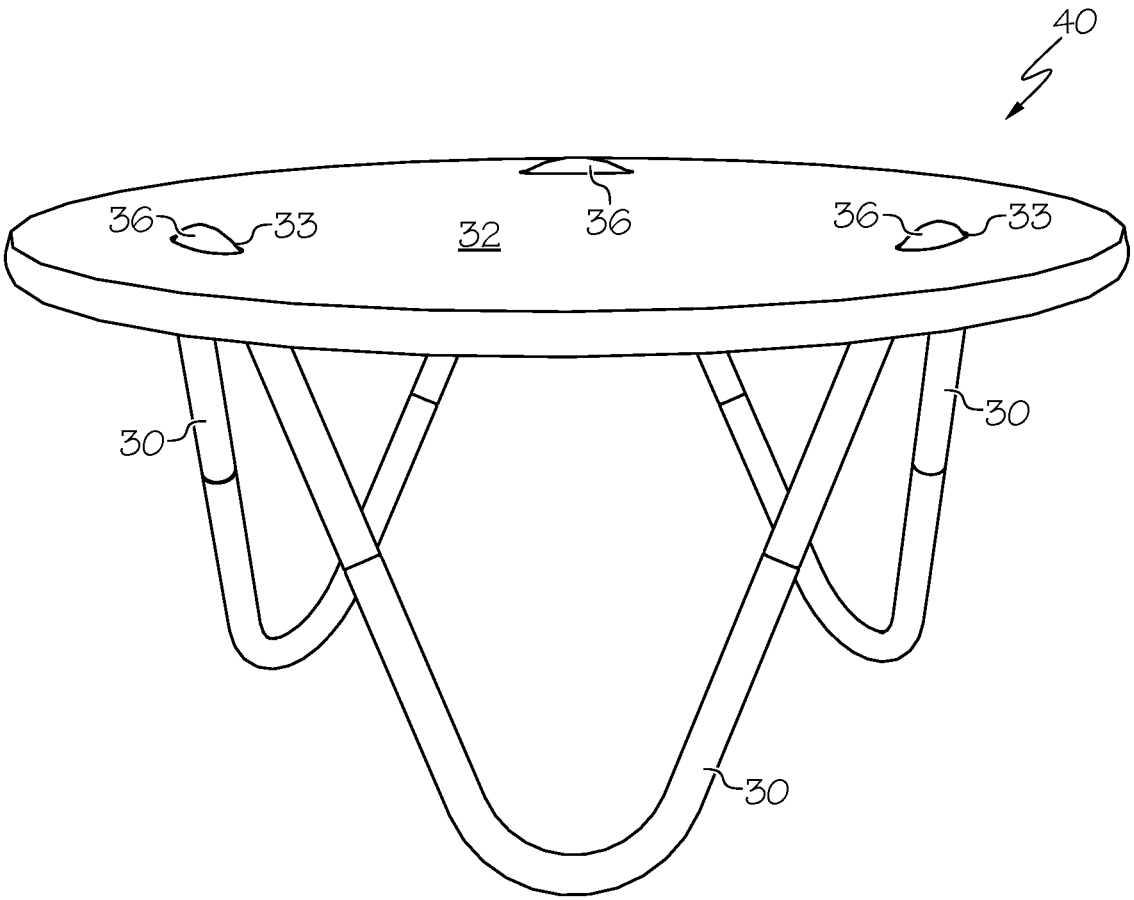
FIG. 5A is a perspective view of an alternative embodiment of the inventive table and support system in an assembled coffee table design.

FIG. 5A is a perspective view of an assembled coffee table 40 having the same, but fewer components as the dining table described and illustrated in FIGS. 4A and 4B. This embodiment includes a styling option and structural assembly created by increasing the depth of the receiver slots 33, so the uppermost ends 36 of the support tubes 30 extend though the surface of the tabletop 32. There are also dimensional changes such that the coffee table is shorter, and the structural components may have smaller sizes and dimensions as well. Also illustrated is the male/female connection of the tubes 30, as each tube 30 has one end with a male section 42 and the opposite end with a female section 44 (as seen in FIG. 5B) that allows for the sliding engagement, attachment and rotation between tube members as discussed above.

Figure 5B:
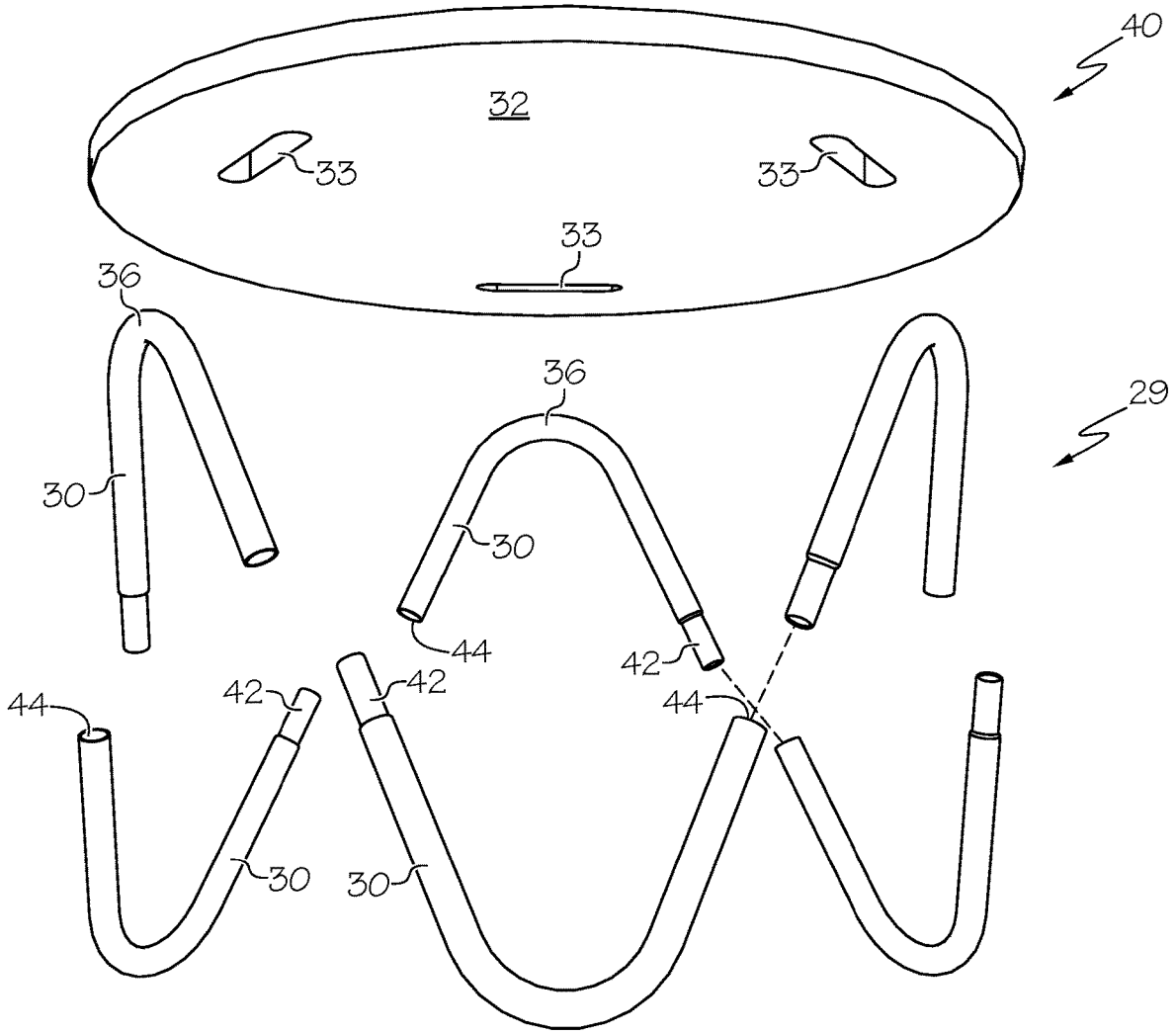
FIG. 5B is an exploded perspective view of the table design depicted in FIG. 5A.

FIG. 5B is an exploded perspective view of the table design and apparatus shown in FIG. 5A, including frame assembly 29.

In the embodiments described herein, a rod is generally referred to as a relatively thin cylindrical member that is not hollow, and a tube is generally referred to as hollow cylindrical member which may be larger, and can be made of metal, plastic or other suitable material.

Figure 6A:
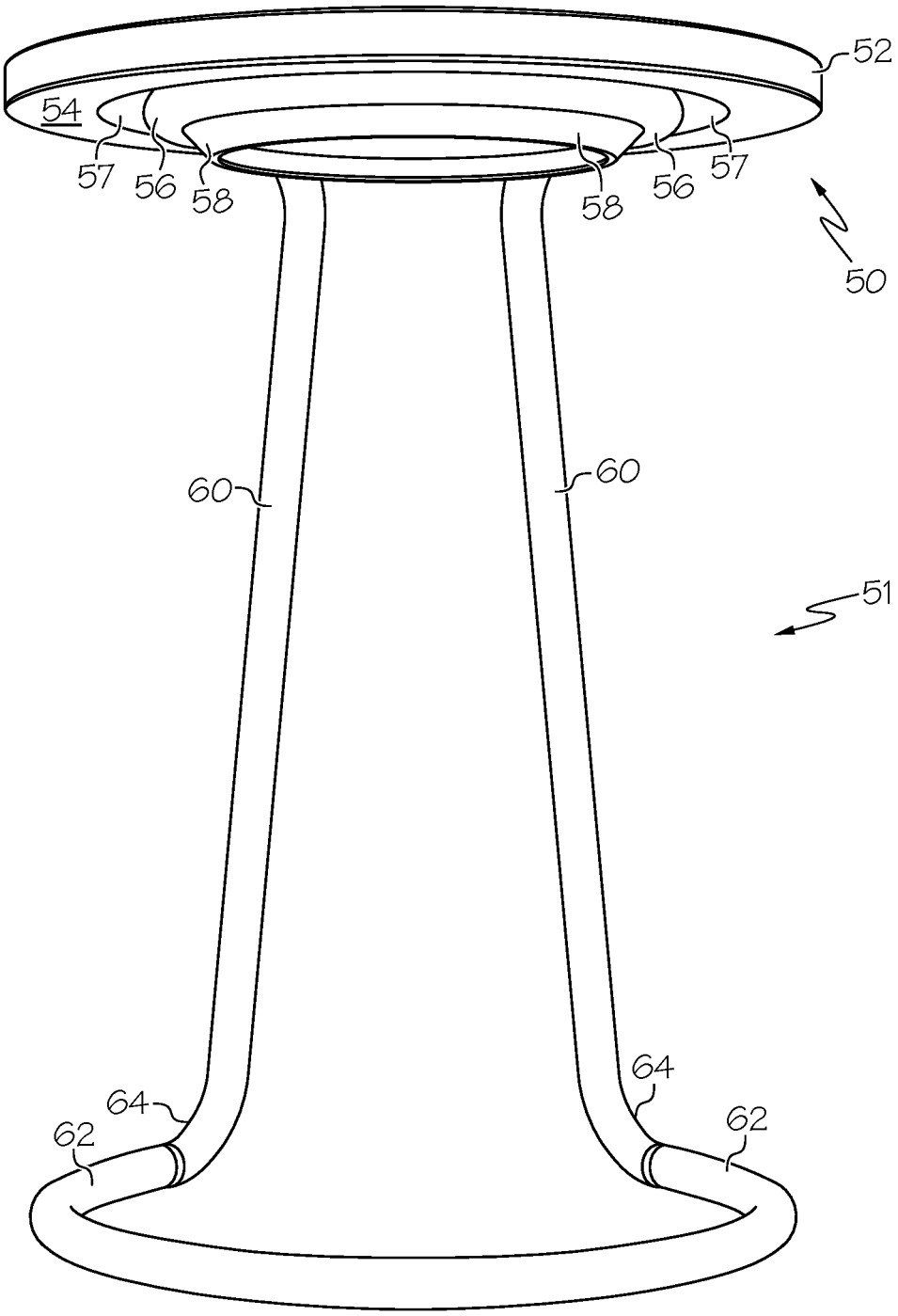
FIG. 6A is a perspective front view of an alternative embodiment of the inventive table and support system in the configuration of an assembled expansion cantilever table design.

FIG. 6A is a perspective front view of an alternative embodiment of the inventive table and support system in the configuration of an assembled expansion cantilever table 50 and design for tension-stabilized tables of the instant inventions. The frame assembly 51 consists of four formed tubes 56, 60 and 62 that interconnect but remain unstable until they are joined by tension to mating features in the underside 54 of the tabletop 52. The horizontal top ring 56 and bottom ring 62 sections of the frame assembly 51 are partial discontinuous tubular ring members that terminate in straight tube sections 60 having an included angle of approximately 60 degrees. The length of the straight tube sections 60 can be approximately twice the outside diameter of the tubes. (The drawing shows approximately 1" tubing and 2" straight sections.) Leg tubes 60 are terminated in their opposing ends 64 with approximately 90 degree bends followed by smaller diameter end sections 61 that slidingly engage and fit into the top ring member 56 and lower base member or bottom ring member 62 at the opposing ends 63 in a male/female connection, as more clearly illustrated with respect to exploded component view of FIG. 6C.

Figure 6B:
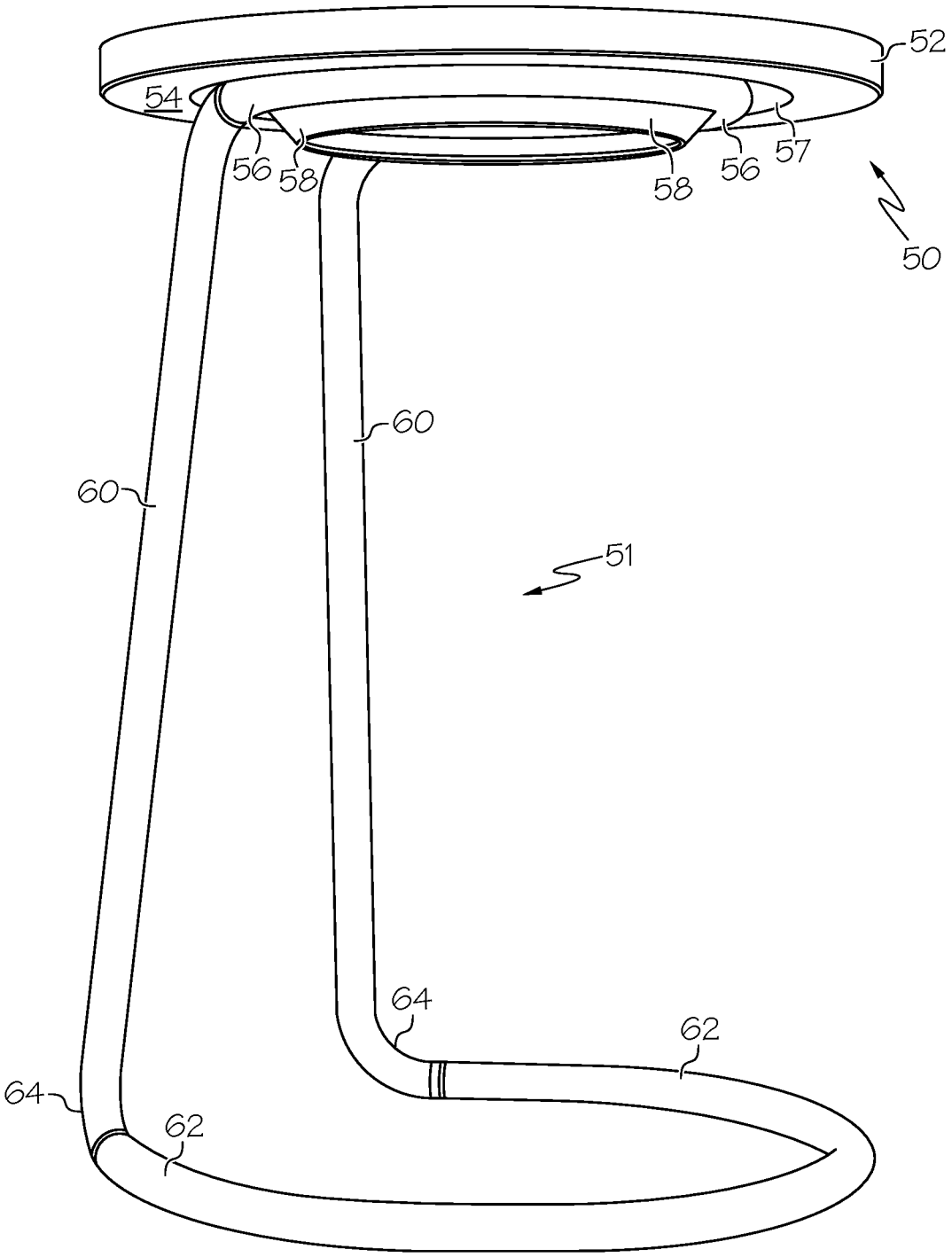
FIG. 6B is a perspective side view of the expansion cantilever table design depicted in FIG. 6A.
Figure 6C:
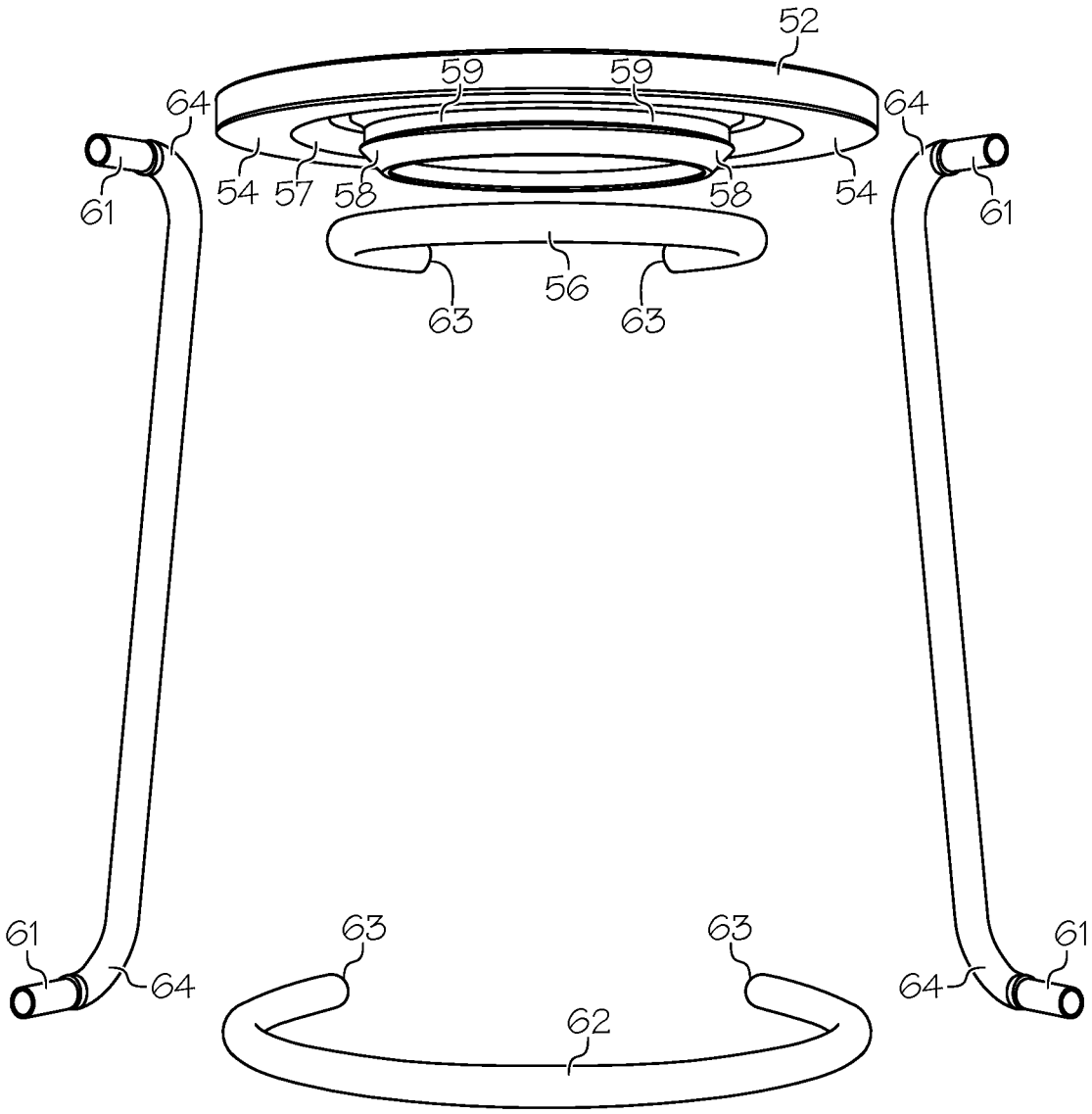
FIG. 6C is an exploded front perspective view of the cantilever table design depicted in FIG. 6A.

The table underside 54 includes circular channel 57 and a central protrusion neck 59 (as shown in FIG. 6C) that terminates in an enlarged diameter neck ring 58. Neck ring 58 has angled sides which receive top tube ring 56. Top tube ring 56 is dimensioned to be smaller than the diameter of neck ring 58, such that when during assembly top ring 56 is caused to initially expand over neck ring 58 and then contract to fit into the smaller diameter channel around protrusion neck 59 in a snap-fit manner as can be seen in FIG. 6C.

FIG. 6B is a perspective side view of the expansion cantilever table 50 depicted in FIG. 6A.

FIG. 6C is an exploded front perspective view of the cantilever table 50 depicted in FIG. 6A. As mentioned, leg tubes 60 terminate in their opposing ends 64 with approximately 90 degree bends as shown followed by the smaller diameter male ends 61. Male ends 61 slidingly engage and fit into tubular top ring member 56 and bottom ring member 62 at their respective opposing ends 63 in a male/female connection. Legs 60 are generally vertical but angled inwardly by smaller upper ring 56.

Figure 7A:
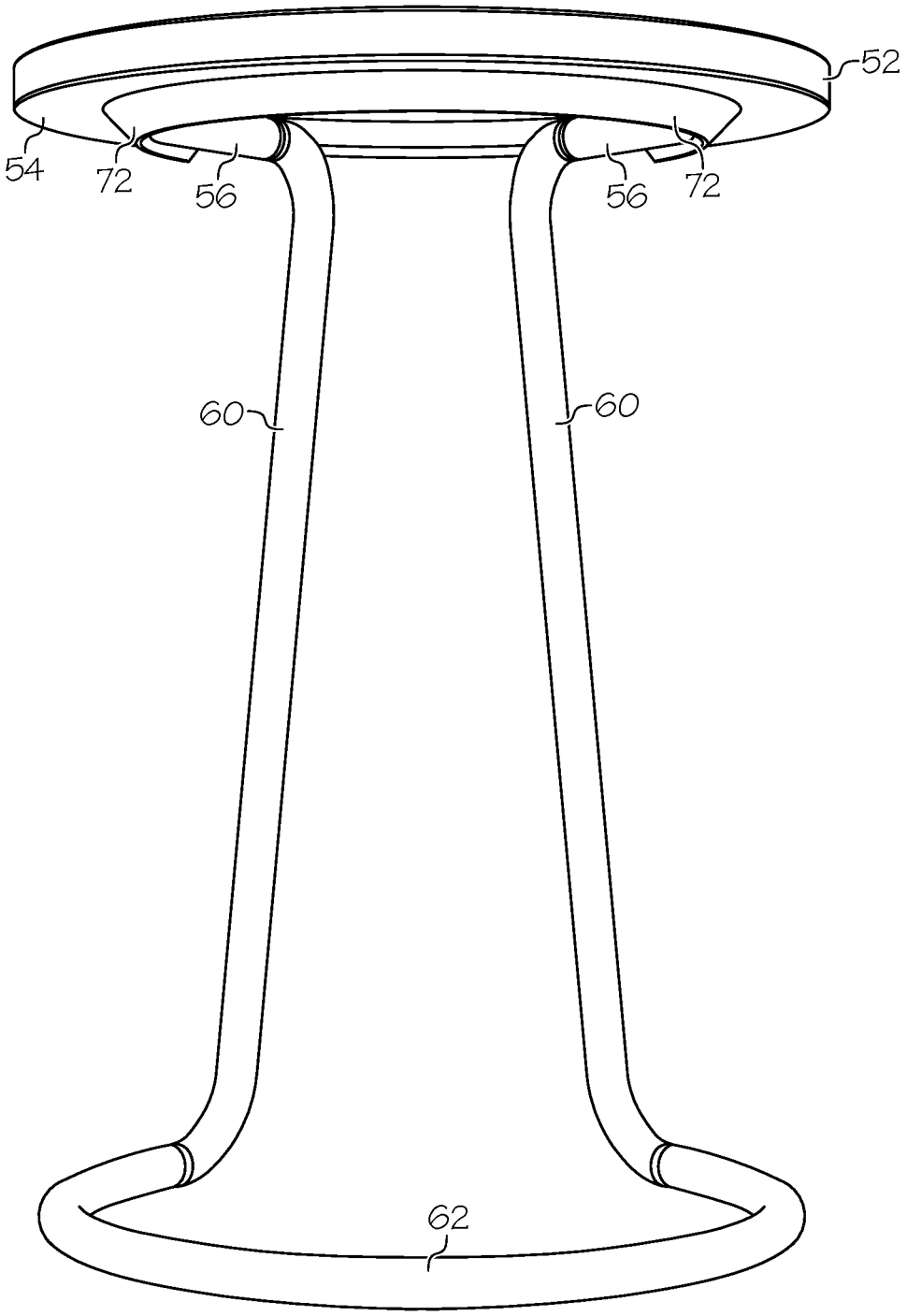
FIG. 7A is a front perspective view of an alternative embodiment of the inventive table and support system in the configuration of an assembled compression cantilever table design.

FIG. 7A is a front perspective view of an alternative embodiment of the inventive table and frame assembly in the configuration of an assembled compression cantilever table 71. Differing from certain components described for the expansion table and frame assembly of FIGS. 6A-6C, in this embodiment table underside 54 includes a protruding surface ring 72 having angled sides and a central area 70. Surface ring 72 receives frame top ring 56 within central area 70. The internal diameter of surface ring 72 in this embodiment is smaller than the diameter of frame top ring 56, such that such that during assembly top ring 56 is caused to initially compress within surface ring 72 and then fit within the smaller diameter central area 70 in a snap-fit snug manner as seen, and also in conjunction with the exploded component view of FIG. 7C.

Figure 7B:
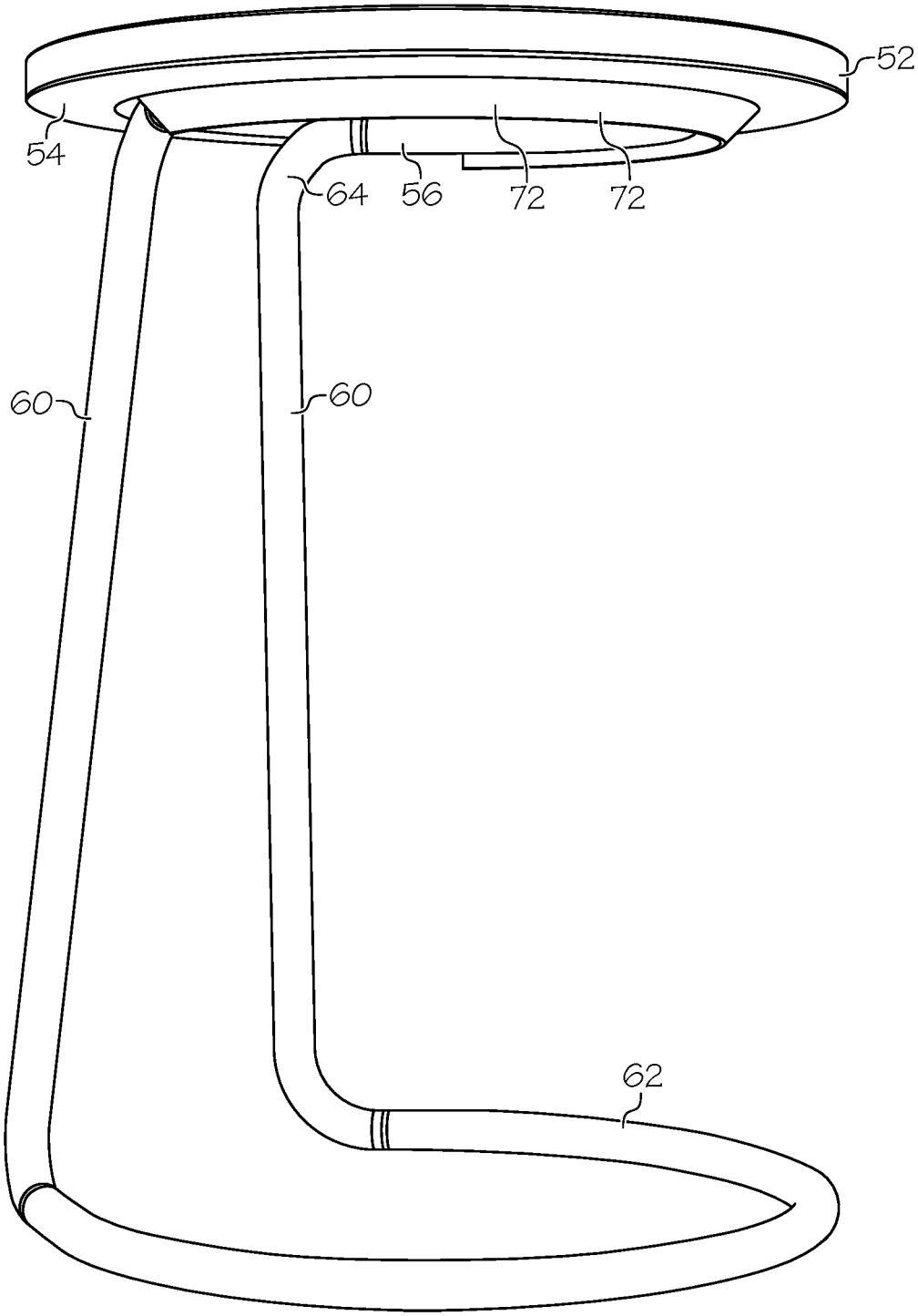
FIG. 7B is a side perspective view of the compression cantilever table shown in FIG. 7A.

FIG. 7B is a side perspective view of the compression cantilever table 71 shown in FIG. 7A.

Figure 7C:
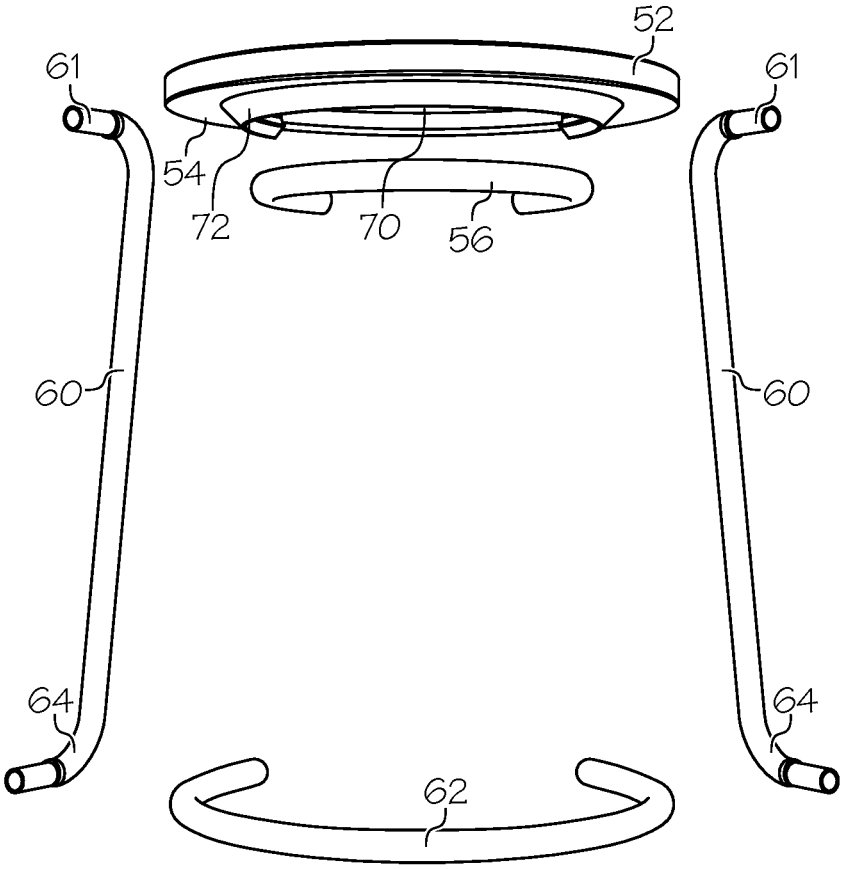
FIG. 7C is an exploded front perspective view of the cantilever table design depicted in FIG. 7A.

FIG. 7C is an exploded front perspective view of the compression cantilever table 71 shown in FIG. 7A, with the separate frame assembly components and tabletop as described.

Figure 7D:
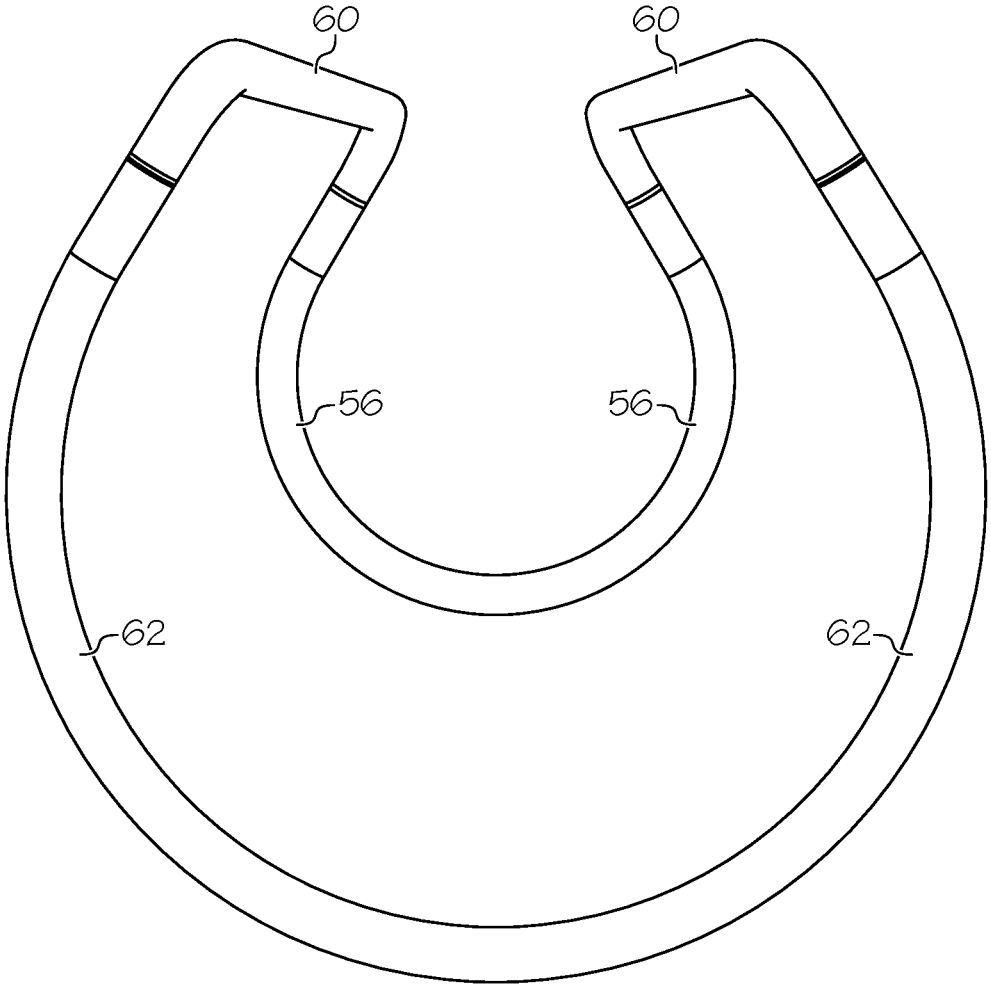
FIG. 7D is a bottom perspective view of the assembled framework of the apparatus shown in FIG. 7A.

FIG. 7D is a top perspective view of the assembled framework of the compression cantilever table 71 shown in FIG. 7A.

Assembly begins with the tabletop inverted on the floor. The four tubes are connected by inserting the ends of each leg into the top and bottom rings with the smaller top ring centered on the underside of the tabletop. Applying force or stepping onto the top ring forces it to engage with the mating surface in the tabletop. The diameter of the mating surfaces is selected to change the diameter of the ring by approximately 5%. The expansion lock increases the ring diameter and the compression lock reduces the diameter. Those diameter changes create tension that locks the ring into the tabletop. Those diameter changes also increase or decrease the original 60 degree ring termination angle by approximately 6 degrees. That 6 degree angle change in the top ring causes each leg to rotate approximately 3 degrees. That rotation forces the opposite ends of the legs into tension with the larger bottom ring as they no longer match the original 60 degree angle of that ring. That tension locks the male ends of the leg tubes into the female receiving ends of the top and bottom tubes. This self-stabilizing behavior of this structure is demonstrated by the tendency of the top surface to spring back to its original centered position after being forced off center.

Figure 8A:
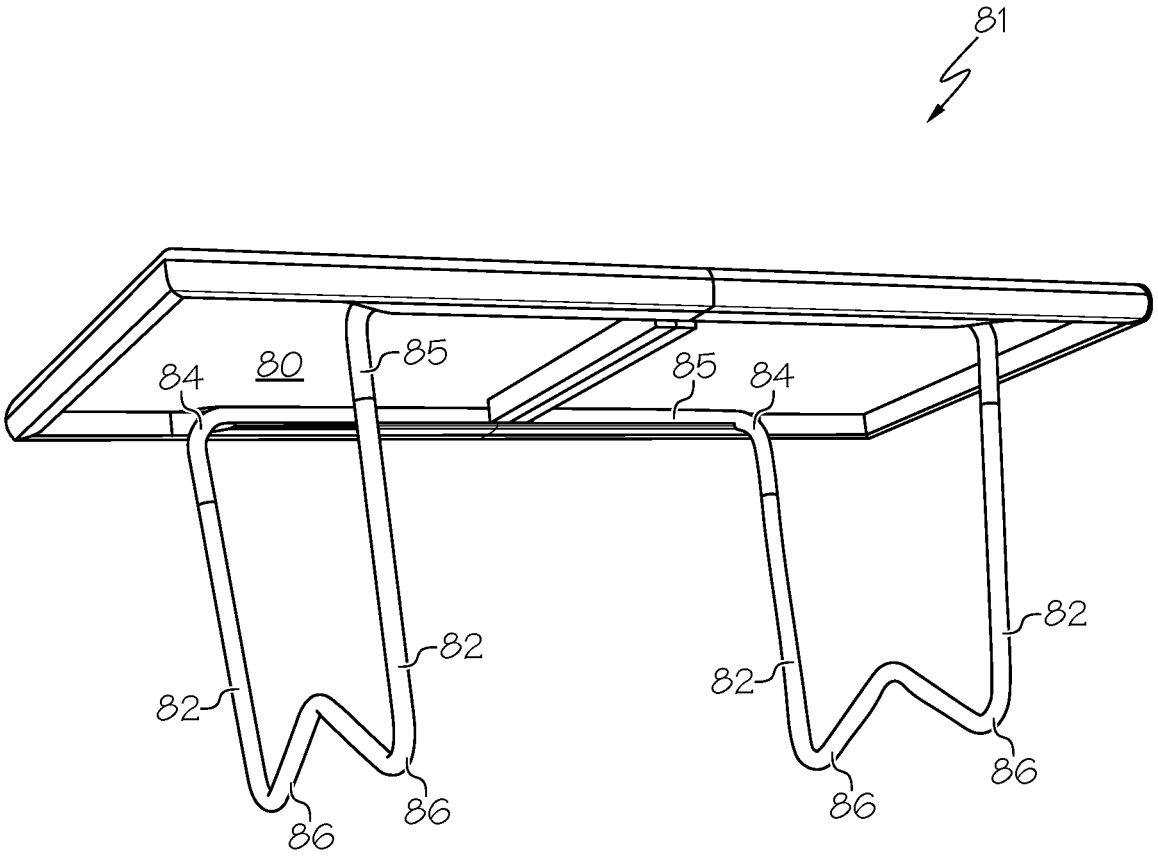
FIG. 8A is a perspective view of an alternative embodiment of the inventive table and support system in the configuration of an assembled rectangular table design.

FIG. 8A is a perspective view of an alternative embodiment of the inventive table and support system in the configuration of an assembled tension-stabilized rectangular table 81.

Figure 8B:
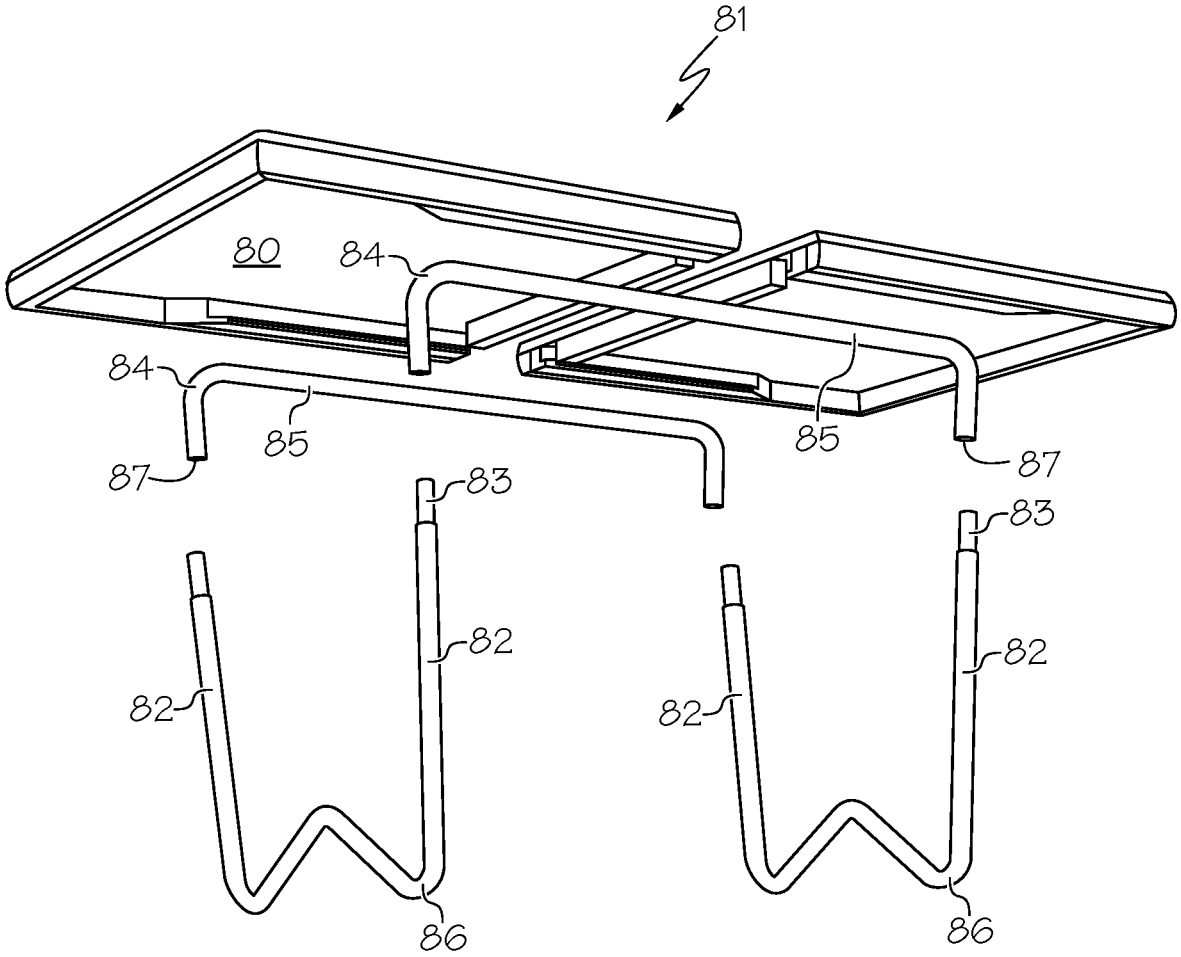
FIG. 8B is an exploded perspective view of the rectangular table design depicted in FIG. 8A.

FIG. 8B is an exploded perspective view of the rectangular table 81 and frame assembly components depicted in FIG. 8A.

With reference to FIGS. 8A and 8B, rectangular table 81 has underside 80, tubular lower front and rear cross rails 82, and tubular side rails 85. In this design, lower cross rails 82 are generally W shaped each having two points of contact 86 and minimal contact with the floor the table would be placed upon. However, as a matter of design choice, the lower cross rails could be a continuous horizontal rail along the floor. As similarly described with respect to the tubular frame designs previously mentioned above, the tubular side rails are supported by male/female member configurations, wherein male sections 83 of lower front cross rail and lower rear cross rail are received by open ends 87 or sockets of the side rails 84. Opposite sides of the side rails themselves include the lower bent sections 84 and female ends 87 sockets to receive the male sections 83 of the lower cross rails. Lower cross rails 82 incorporate outwardly and upwardly widened leg members that provide the tensioning and stabilization of the furniture in conjunction with the table top when attached. Table underside 80 has receiving channels or tubular receivers 88 (as seen in FIGS. 8C and 8D) to attach the tubular frame assembly to the table.

Figure 8C:
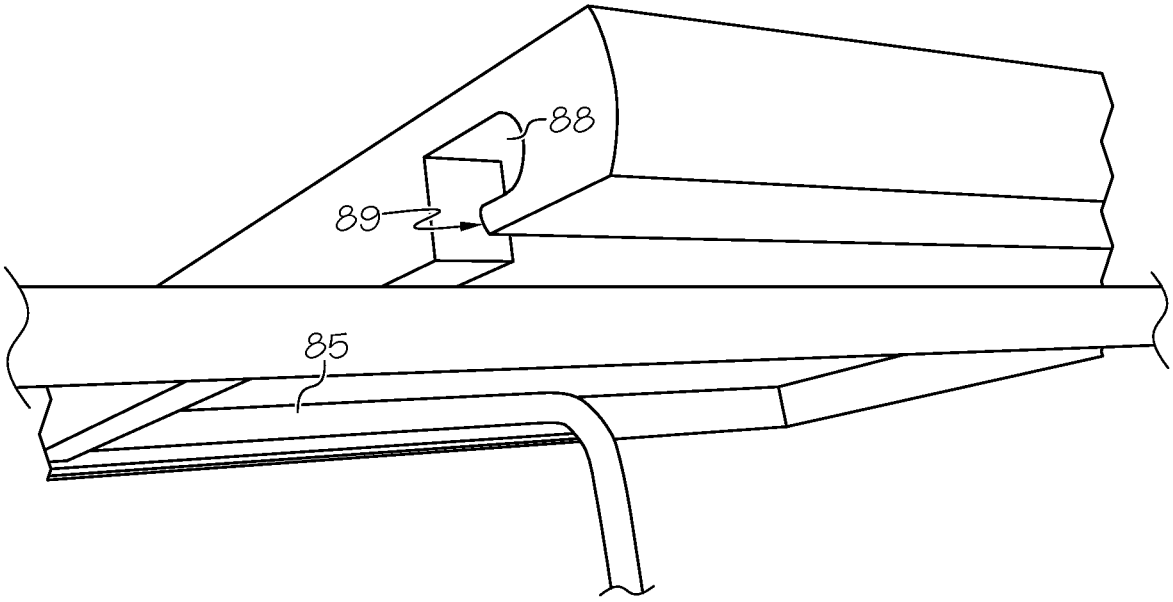
FIG. 8C is an enlarged sectional exploded perspective view of a corner of the rectangular table design in FIG. 8B.

FIG. 8C is an enlarged sectional exploded perspective view of a corner of the rectangular table design in FIG. 8B, prior to the insertion of side rail 85 through the open end 89 and into the tubular channel 88.

Figure 8D:
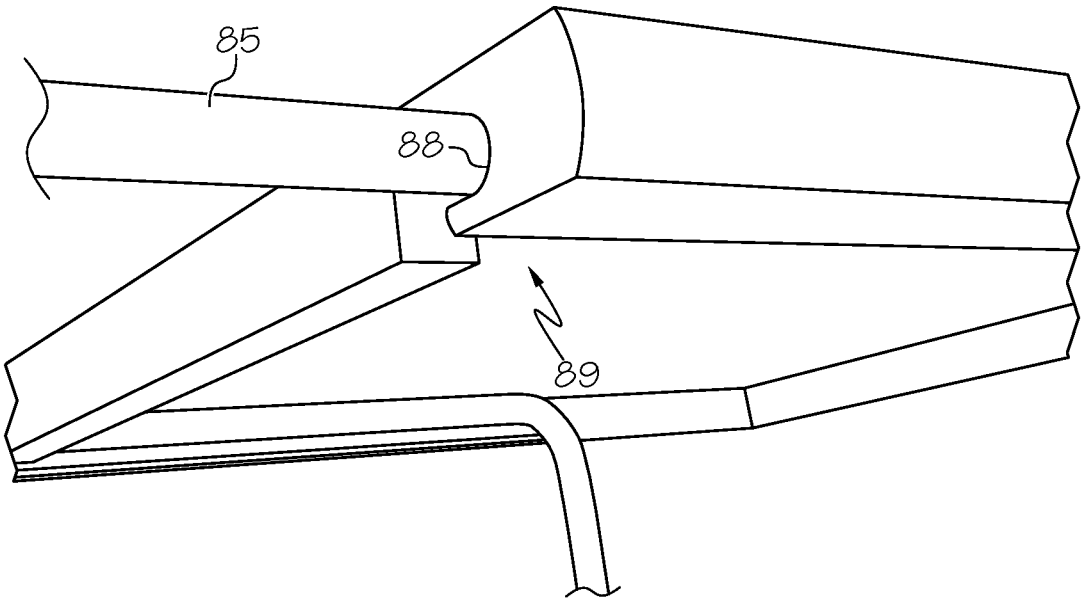
FIG. 8D is an enlarged sectional assembled perspective view of a corner of the rectangular table design shown in FIG. 8C.

FIG. 8D is an enlarged sectional assembled perspective view of a corner of the rectangular table design shown in FIG. 8C, with side rail 85 fit securely within receiving channel 88.

With regard to all of the instant table embodiments and designs, joining the frame elements and engaging them with surface features creates a fundamentally simple self-tensioning structure with the extraordinary physical characteristic of uniformly distributed tension. This rare attribute, known as distributed compliance as previously mentioned, is a structural ideal that maximizes strength and stability without rigidity or high tension. This advantage does not exist in previous framed support structures, which are classified as lumped compliance devices because they concentrate stress on one or more points. Benefits of distributed compliance include self-stabilization, extreme reliability and safety.

The most significant differences between the current inventions and previous designs are the means employed to connect and stabilize the supporting structures.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is to be understood that both the foregoing descriptions are exemplary and explanatory only and are not restrictive of the methods and devices described herein. It is intended that the scope of the invention be defined by the Claims appended hereto and their equivalents.

What is claimed is:

1. A tension-stabilized frame system for receiving a tabletop, comprising:

a frame assembly, said frame assembly having a plurality of upper support frame members, a plurality of lower support frame members, and tensioning frame members, said frame members being linked and interconnected to one another;

when assembled, said frame members form a spring network;

each of said support frame members having a bent angled generally V shape, including first and second legs, said legs being generally straight and angled outwardly, diverging from a common center;

said upper support frame members being inverted above said lower support frame members;

a first leg of an upper support frame member connected to one leg of one lower support frame member, the second leg of said upper support frame member connected to one leg of another lower support frame member;

said legs of each said upper support frame member being alternately connected to legs of adjacent lower support frame members;

said upper support frame members and said lower support frame members alone forming a non-rigid and unstable frame assembly;

said unstable frame assembly allowing an undesirable rotational change in alignment of said frame assembly upon application of pressure forces;

said tensioning frame members including a central ring and a plurality of tensioning straps;

said tensioning straps having opposing ends;

said tensioning straps opposing ends being connected to said central ring at one end, and connected to an upper support frame member at the opposing end; and said central ring and said tensioning straps together compressing said frame assembly and said support frame members, interlocking, tensioning and stabilizing said unstable frame assembly when assembled together.

2. The apparatus of claim 1, further comprising:

said upper support frame members and said lower support frame members form a three dimensional and continuous, closed loop frame assembly, each upper support frame member alternately interconnected with two lower support frame members.

3. The apparatus of claim 2, wherein said legs of said upper support frame members are connected to said legs of said lower support frame members in male-female connections.

4. The apparatus of claim 2, further comprising:

a plurality of connectors, said connectors having internal receivers at opposite ends;

said upper and lower support frame members are attached with said plurality of connectors;

said upper and lower support frame members are rods; and said each said connector receives a leg of an upper frame member at one end and a leg of a lower frame member at the opposite end, in sliding engagement.

5. The apparatus of claim 2, further comprising:

said frame assembly having no additional support, cross bars, hinges, pipes or hardware, and is solely assembled utilizing said upper and lower support frame members, central ring and tensioning straps.

6. The apparatus of claim 1, wherein said upper and lower support frame members are tubular;

said central ring is tubular;

said tensioning straps are rigid;

said opposing ends of said tensioning straps are hook ends; and said hook ends receive said central ring and said upper support frame members.

* * * * *